US009517779B2

(12) United States Patent
Rush et al.

(10) Patent No.: US 9,517,779 B2
(45) Date of Patent: Dec. 13, 2016

(54) SYSTEM AND METHOD FOR COMMUNICATING IN A VEHICLE CONSIST

(71) Applicant: General Electric Company, Schenectady, NY (US)

(72) Inventors: Daniel Rush, Melbourne, FL (US); Eugene Smith, Melbourne, FL (US); Glen Paul Peltonen, Melbourne, FL (US); Mark Wayne Wheeler, Melbourne, FL (US); Robert Carmen Palanti, Melbourne, FL (US); Maurice Stanley Hutchins, Melbourne, FL (US)

(73) Assignee: General Electric COmpany, Schenectady, NY (US)

( * ) Notice: Subject to any disclaimer, the term of this patent is extended or adjusted under 35 U.S.C. 154(b) by 64 days.

(21) Appl. No.: 14/507,883

(22) Filed: Oct. 7, 2014

(65) Prior Publication Data

US 2015/0025712 A1 Jan. 22, 2015

Related U.S. Application Data

(63) Continuation-in-part of application No. 13/537,155, filed on Jun. 29, 2012, now Pat. No. 8,983,759.
(Continued)

(51) Int. Cl.
*B61C 17/12* (2006.01)
*B61L 15/00* (2006.01)

(52) U.S. Cl.
CPC ..... *B61C 17/12* (2013.01); *B61L 15/0027* (2013.01); *B61L 15/0081* (2013.01)

(58) Field of Classification Search
CPC ... B61C 17/12; B61L 15/0081; B61L 15/0027
See application file for complete search history.

(56) References Cited

U.S. PATENT DOCUMENTS 4,553,723 A 11/1985 Nichols et al.
4,582,280 A 4/1986 Nichols et al.
(Continued)

FOREIGN PATENT DOCUMENTS

CN 1630596 A 6/2005
CN 102307771 A 1/2012
(Continued)

OTHER PUBLICATIONS

Unofficial English Translation of Chinese Office Action issued in connection with Related CN Application No. 201380034705.9 on Sep. 1, 2015.
(Continued)

*Primary Examiner* — John Q Nguyen
*Assistant Examiner* — Michael Kerrigan
(74) *Attorney, Agent, or Firm* — John A. Kramer; Global Patent Operation

(57) ABSTRACT

A system and method communicate a command message from a lead vehicle in a vehicle consist having remote vehicles and the lead vehicle. The command message includes a directive for controlling operations of the remote vehicles. The command message is received at the remote vehicles and reply messages are communicated in response thereto. The reply messages include statuses of the remote vehicles. Responsive to determining that the lead vehicle does not receive the reply message from one or more of the remote vehicles, the statuses of the one or more remote vehicles from which the reply messages are not received at the lead vehicle are sent and/or combined into an individual or concatenated relayed message. The individual or concatenated relayed messages are communicated to the lead vehicle such that the lead vehicle receives the statuses of the one or more remote vehicles.

22 Claims, 8 Drawing Sheets

Related U.S. Application Data

(60) Provisional application No. 61/900,551, filed on Nov. 6, 2013.

(56) References Cited

U.S. PATENT DOCUMENTS

| | | | | |
|---|---|---|---|---|
| 5,720,455 | A | 2/1998 | Kull et al. | |
| 5,950,967 | A | 9/1999 | Montgomery | |
| 5,969,643 | A | 10/1999 | Curtis | |
| 7,038,597 | B2 * | 5/2006 | Smith | B60L 3/12 340/12.54 |
| 8,428,798 | B2 | 4/2013 | Kull | |
| 2003/0151520 | A1 | 8/2003 | Kraeling et al. | |
| 2011/0286464 | A1 | 11/2011 | Shigeeda et al. | |

FOREIGN PATENT DOCUMENTS

| | | | |
|---|---|---|---|
| KZ | 386 | U | 8/2008 |
| RU | 2238860 | C1 | 10/2004 |

OTHER PUBLICATIONS

Unofficial English Translation of KZ Office Action issued in connection with corresponding KZ Application No. 2014/2524.1 on Apr. 13, 2016.

* cited by examiner

SYSTEM AND METHOD FOR COMMUNICATING IN A VEHICLE CONSIST

CROSS-REFERENCE TO RELATED APPLICATIONS

This application claims priority to U.S. Provisional Application Ser. No. 61/900,551, which was filed on 6 Nov. 2013 (the "'551 application"). This application also is a continuation-in-part of U.S. patent application Ser. No. 13/537,155, which was filed on 29 Jun. 2012 (the "'155 application"). The entire disclosures of the '551 application and the '155 application are incorporated herein by reference.

FIELD

Embodiments of the inventive subject matter described herein relate to communications between vehicles in a vehicle consist.

BACKGROUND

Some known vehicle consists include several powered vehicles that generate tractive effort for propelling the vehicle consists along a route. For example, trains may have several locomotives coupled with each other that propel the train along a track. The locomotives may communicate with each other in order to coordinate the tractive efforts and/or braking efforts provided by the locomotives. As one example, locomotives may be provided in a distributed power (DP) arrangement with one locomotive designated as a lead locomotive and other locomotives designated as remote locomotives. The lead locomotive may direct the tractive and braking efforts provided by the remote locomotives during a trip of the consist.

Some known consists use wireless communication between the locomotives for coordinating the tractive and/or braking efforts. For example, a lead locomotive can issue commands to the remote locomotives. The remote locomotives receive the commands and implement the tractive efforts and/or braking efforts directed by the commands. In order to ensure that the remote locomotives receive the commands, the lead locomotive may periodically re-communicate the commands until all of the remote locomotives confirm receipt of the commands by communicating a confirmation message to the lead locomotive.

Due to interference with wireless communications caused by other wireless devices, significant distance between locomotives, travel through tunnels or urban areas, and the like, some confirmation messages may not be received by the lead locomotive. As a result, the lead locomotive may continue to re-send the commands to the remote locomotives on a periodic basis, even if the remote locomotives have received the commands. Some lead locomotives declare a communication error or loss of communication state when all of the remote locomotives do not reply to command messages after a designated number of re-transmissions of the command messages. Such a communication error state alerts the operator of the loss of communication with the remote locomotives and may cause the operator undue concern about the operating state of the remote locomotives and the operator to slow or stop movement until the error can be examined and/or repaired. If the cause of the error state is that the remote locomotives are receiving the command messages but the lead locomotive is not receiving all of the confirmation messages from the remote locomotives, such an communication error state may be unnecessary and consume considerable time during the scheduled travels of the consist.

BRIEF DESCRIPTION

In one embodiment, a method (e.g., for communicating in a vehicle consist) includes, onboard a first remote vehicle in a vehicle consist having at least a lead vehicle, the first remote vehicle, and a second remote vehicle, receiving a second reply message from the second remote vehicle in response to communication of a command message from the lead vehicle to the first remote vehicle and the second remote vehicle. The command message includes a directive for controlling one or more operations of the first remote vehicle and the second remote vehicle. The second reply message indicates a status of the second remote vehicle. The method also can include combining the status of the second remote vehicle at the first remote vehicle with a status of one or more of the first remote vehicle or another vehicle in the vehicle consist into a concatenated relayed message, and communicating the concatenated relayed message from the first remote vehicle to the lead vehicle such that the lead vehicle receives the status of the second remote vehicle.

In another embodiment, a system (e.g., a communication system of a vehicle consist) includes a remote communication unit and a control unit. The remote communication unit is configured to be disposed onboard a first remote vehicle in a vehicle consist having at least a lead vehicle, the first remote vehicle, and a second remote vehicle. The remote communication unit also can be configured to receive a second reply message from the second remote vehicle in response to communication of a command message from the lead vehicle to the first remote vehicle and the second remote vehicle. The command message includes a directive for controlling one or more operations of the first remote vehicle and the second remote vehicle, the second reply message indicating a status of the second remote vehicle. The control unit can be configured to be disposed onboard the first remote vehicle and to combine the status of the second remote vehicle at the first remote vehicle with a status of one or more of the first remote vehicle or another vehicle in the vehicle consist into a concatenated relayed message. The control unit also can be configured to direct the remote communication unit to communicate the concatenated relayed message to the lead vehicle such that the lead vehicle receives the status of the second remote vehicle.

In another embodiment, a method (e.g., for communicating in a vehicle consist) includes communicating a command message from a lead vehicle in a vehicle consist having plural remote vehicles coupled with the lead vehicle. The command message includes a directive for controlling one or more operations of the remote vehicles. The method also can include separately receiving one or more reply messages from less than all of the plural remote vehicles in the vehicle consist in response to the command message. The one or more reply messages include statuses of less than all of the plural remote vehicles in the vehicle consist. The method may further include communicating a retry message from the lead vehicle that identifies a subset of the remote vehicles in the vehicle consist from which the one or more reply messages were not received in response to the command message, and receiving an individual or concatenated relayed message from a first remote vehicle in the plural remote vehicles of the vehicle consist. The individual or concatenated relayed message can include the status of one or more of the remote vehicles in the subset from which the one or more reply messages were not received.

In another embodiment, another system (e.g., another communication system of a vehicle consist) includes a lead communication unit and a control unit. The lead communication unit is configured to be disposed onboard a lead vehicle in a vehicle consist having plural remote vehicles coupled with the lead vehicle. The lead communication unit also can be configured to communicate a command message that includes a directive for controlling one or more operations of the remote vehicles, and to separately receive one or more reply messages from less than all of the plural remote vehicles in the vehicle consist in response to the command message, the one or more reply messages including statuses of less than all of the plural remote vehicles in the vehicle consist. The control unit is configured to be disposed onboard the lead vehicle and to identify a subset of the remote vehicles in the vehicle consist from which the one or more reply messages were not received in response to the command message. The control unit can be configured to direct the lead communication unit to communicate a retry message that identifies a subset of the remote vehicles in the vehicle consist from which the one or more reply messages were not received in response to the command message. The control unit also can be configured to receive, via the lead communication unit, an individual or concatenated relayed message from a first remote vehicle in the plural remote vehicles of the vehicle consist. The individual or concatenated relayed message includes the status of one or more of the remote vehicles in the subset from which the one or more reply messages were not received.

BRIEF DESCRIPTION OF THE DRAWINGS

Reference is now made briefly to the accompanying drawings, in which.

DETAILED DESCRIPTION

Figure 1:
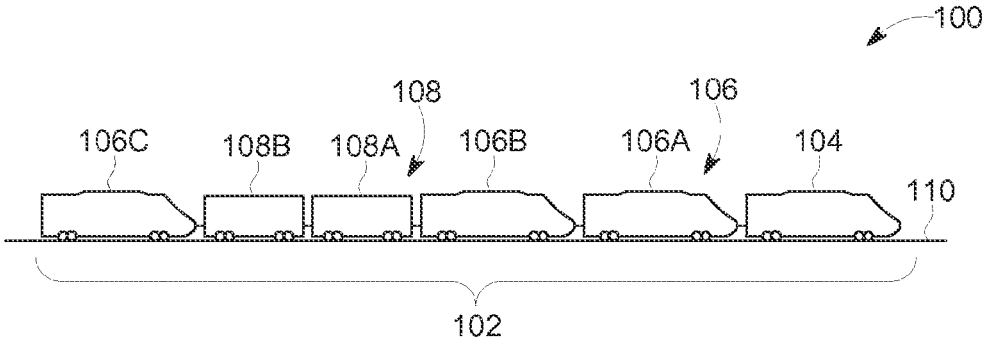
FIG. 1 is a schematic view of one embodiment of a communication system of a vehicle consist.

One or more embodiments of the inventive subject matter described herein provides for methods and systems for communicating between propulsion-generating vehicles in a vehicle system that includes two or more of the propulsion-generating vehicles coupled with each other. For example, embodiments of the inventive subject matter may be used in connection with rail vehicles and rail vehicle consists, or other types of vehicles. In one aspect, one of the vehicles generates command signals that are communicated (e.g., broadcast, transmitted, or both broadcast and transmitted) to the other vehicles in the vehicle system. The vehicle that sends the command signals can be referred to as a lead vehicle without the vehicle necessarily being disposed at the front of the vehicle system along a direction of travel. The other vehicles may be referred to as remote vehicles and receive the command signals from the lead vehicle. These command signals can be used by the lead vehicle to remotely control operations (e.g., throttle settings, brake settings, and the like) of the remote vehicles. In response to receiving the command signal, the remote vehicles send a responsive message with the status and identity of the remote vehicle sending the responsive message. This responsive message is received by the lead vehicle so that the lead vehicle can confirm that the remote vehicles all received the previously sent command signal. The lead and remote vehicles may be assigned different time slots in a message cycle time period in which the vehicles are allowed to transmit, broadcast, or both transmit and broadcast the messages from the respective vehicles.

But, if one or more of the responsive messages are not received by the lead vehicle, then the lead vehicle is unable to confirm that the latest command signal was received by the remote vehicles in the vehicle consist. In order to increase the reliability in the lead vehicle receiving the responsive messages, one aspect of the inventive subject matter described herein allows for the remote vehicles to repeat the statuses and identities of one or more other remote vehicles from which the lead vehicle did not receive a responsive message from. For example, in a vehicle system having a lead vehicle A and four remote vehicles B, C, D, E (or another number of remote vehicles), the lead vehicle A may send a retry message to the remote vehicles B, C, D, E that indicates that the lead vehicle A did not receive a responsive message from the remote vehicle E (or another remote vehicle). This retry message from the lead vehicle A may identify the remote vehicle E. In response to receiving the retry message, the other remote vehicles B, C, D may listen for another responsive message from the remote vehicle E (e.g., sent in response to the retry message) and, if the responsive message is received by the remote vehicle B, C, or D, then this remote vehicle B, C, or D can send a relay message to the lead vehicle A. The relay message can include the status of the remote vehicle E.

In one embodiment, the lead vehicle A sends a first retry message in a first message cycle. If the lead vehicle A is unable to receive the relay message having the status of the remote vehicle E from one or more of the remote vehicles B, C, D during this first message cycle, then the lead vehicle A may send another retry message to the remote vehicles B, C, D, E in a different, subsequent second message cycle. For example, the remote vehicle D may be unsuccessful in communicating the status of the remote vehicle E to the lead vehicle A in the relay message during the first message cycle, but may be successful in communicating the status of the remote vehicle E to the remote vehicle B and/or C during the first message cycle. The remote vehicles B and/or C may store the status of the remote vehicle E received from the remote vehicle D in the relay message sent during the first message cycle.

Then, the lead vehicle A re-sends the retry message during the different, subsequent second message cycle. During this second message cycle, the remote vehicles B and/or C receive the retry message and attempt to communicate a relay message (that includes the status of the remote vehicle E) to the lead vehicle A. If the relay message is received by the lead vehicle A, then the lead vehicle A has been successfully updated with the status of the remote vehicle E. If the relay message is not received by the lead vehicle A, then one or more additional message cycles may be needed to update the status of the remote vehicle E at the lead vehicle A, such as by the lead vehicle A sending additional retry messages in the additional message cycles.

In another embodiment, the status of the remote vehicle E (or another remote vehicle) can be communicated to and received by the lead vehicle A during a single message cycle, instead of over multiple message cycles (as described above). For example, in response to the retry message that is sent from the lead vehicle A during the first message cycle described above, the remote vehicle E sends the status of the remote vehicle E, such as by broadcasting, transmitting, or both broadcasting and transmitting the responsive message from the remote vehicle E to plural ones of the remote vehicles B, C, D. The remote vehicles that receive the responsive message may then extract the status of the remote vehicle E and send this status in a relay message during the time slot assigned to the remote vehicle. For example, if the remote vehicle D receives the responsive message from the remote vehicle E, then the remote vehicle D can send a relay message with this status to the lead vehicle A during the time slot assigned to the remote vehicle D during the same first message cycle. If the remote vehicle C receives the status of the remote vehicle E (e.g., either directly from the responsive message sent by the remote vehicle E, from the relay message sent by the remote vehicle D, or from both the responsive message and the relay message), then the remote vehicle C can send the status of the remote vehicle E to the lead vehicle A in a relay message sent during the time slot assigned to the remote vehicle C in the first message cycle. If the remote vehicle B receives the status of the remote vehicle E (e.g., either directly from the responsive message sent by the remote vehicle E, from the relay message sent by the remote vehicle D, from the relay message sent by the remote vehicle C, or from a combination thereof), then the remote vehicle B can send the status of the remote vehicle E to the lead vehicle A during the time slot assigned to the remote vehicle B in the first message cycle.

Sending the status of one or more other remote vehicles in the time slot assigned to one or mother other vehicles during the same messaging cycle can reduce the time needed to communicate the status of the one or more other remote vehicles to the lead vehicle. Additionally or alternatively, sending the status of the one or more remote vehicles in this manner can increase the probability that the lead vehicle receives the status of the remote vehicle. For example, instead of a single remote vehicle B, C, or D sending the status of the remote vehicle E to the lead vehicle A in a single message cycle, the lead vehicle A may receive the status of the remote vehicle E from two or more (or all) of the remote vehicles B, C, D, E (e.g., directly from the remote vehicle E or relayed from one or more of the remote vehicles B, C, and/or D). This can increase the chances that the lead vehicle A will receive the status as the lead vehicle A may be more likely to receive the status of the remote vehicle E if the status is sent in multiple messages instead of just a single message per message cycle.

Optionally, when the lead vehicle A identifies two or more remote vehicles that the lead vehicle A has not received a responsive message from, one or more other remote vehicles can concatenate (e.g., combine) the statuses of these remote vehicles into a single relay message and send the relay message to the lead vehicle A during the same message cycle. For example, if the lead vehicle A sends a retry message in a first message cycle that identifies the remote vehicles D and E as being the remote vehicles from which the lead vehicle A did not receive a responsive message to the retry message, the remote vehicle B and/or C can receive the statuses of the remote vehicles D and E, combine these statuses into a single relay message, and send this single relay message during the time slot assigned to the corresponding remote vehicle B and/or C in the same first message cycle.

FIG. 1 is a schematic view of one embodiment of a communication system 100 of a vehicle consist or vehicle system 102. The illustrated vehicle consist 102 includes powered vehicles 104, 106 (e.g., vehicles 104, 106A, 106B, 106C) and non-powered vehicles 108 (e.g., vehicles 108A, 108B) mechanically coupled with each other. By "powered," it is meant that the powered vehicles 104, 106 include propulsion subsystems that act to propel the vehicles 104, 106 such that the vehicles 104, 106 are self-propelled. By "non-powered," it is meant that the vehicles 108 do not include the propulsion subsystems and are not capable of self-propulsion, but may otherwise receive power (e.g., electric energy) for one or more purposes. The powered vehicles may be referred to as "propulsion-generating vehicles" because the vehicles are capable of self-propulsion while the non-powered vehicles may be referred to as "non-propulsion-generating vehicles" because the vehicles are not capable of self-propulsion.

The powered vehicles 104, 106 are shown as locomotives, the non-powered vehicles 108 are shown as rail cars, and the vehicle consist 102 is shown as a train in the illustrated embodiment. Alternatively, the vehicles 104, 106 may represent other vehicles, such as automobiles, marine vessels, or the like, and the vehicle consist 102 can represent a grouping or coupling of these other vehicles. The number and arrangement of the vehicles 104, 106 in the vehicle consist 102 are provided as one example and are not intended as limitations on all embodiments of the inventive subject matter described herein.

The powered vehicles 104, 106 can be arranged in a distributed power (DP) arrangement. For example, the powered vehicles 104, 106 can include a lead vehicle 104 that issues command messages to the other powered vehicles 106A, 106B, 106C which are referred to herein as remote vehicles. The designations "lead" and "remote" are not intended to denote spatial locations of the powered vehicles 104, 106 in the vehicle consist 102, but instead are used to indicate which powered vehicle 104, 106 is communicating (e.g., transmitting, broadcasting, or a combination of transmitting and broadcasting) command messages and which powered vehicles 104, 106 are being remotely controlled using the command messages. For example, the lead vehicle 104 may or may not be disposed at the front end of the vehicle consist 102 (e.g., along a direction of travel of the vehicle consist 102). Additionally, the remote vehicles 106A-C need not be separated from the lead vehicle 104. For example, a remote vehicle 106A-C may be directly coupled with the lead vehicle 104 or may be separated from the lead vehicle 104 by one or more other remote vehicles 106A-C and/or non-powered vehicles 108.

The command messages may include directives that direct operations of the remote vehicles. These directives can include propulsion commands that direct propulsion subsystems of the remote vehicles to move at a designated speed and/or power level, brake commands that direct the remote vehicles to apply brakes at a designated level, and/or other commands. The lead vehicle 104 issues the command messages to coordinate the tractive efforts and/or braking efforts provided by the powered vehicles 104, 106 in order to propel the vehicle consist 102 along a route 110, such as a track, road, waterway, or the like.

The command messages can be communicated using the communication system 100, as described below. In one embodiment, the command messages are wirelessly communicated using the communication system 100. Due to various impediments to wireless communication, some command messages may not be received by one or more of the remote vehicles 106. In order to confirm whether a command message is received by the remote vehicles 106, the remote vehicles 106 that receive the command message respond by communicating a reply message. For example, responsive to receiving the command message from the lead vehicle 104, a remote vehicle 106 may communicate a reply message.

The reply message notifies the lead vehicle 104 that the remote vehicle 106 received the command message from the lead vehicle 104. The reply message can include a status of the remote vehicle 106 that communicates the reply message, an identity of the remote vehicle 106 that communicates the reply message, or a combination of this status and identity. The status can include data in the reply message (e.g., one or more bits or bytes) that represent one or more current operational states of the remote vehicle 106, such as a currently implemented tractive effort, a currently implemented braking effort, one or more operational errors of the remote vehicle 106, or the like. The status may not merely indicate whether the remote vehicle 106 is turned on or off. Instead, the status may indicate one of several potential operative states of the remote vehicle 106. The identity can include data in the reply message that represents which remote vehicle 106 communicated the reply message. For example, the different remote vehicles 106 may be associated with distinct identifiers (e.g., unique numeric and/or alphanumeric sequences or codes) that can be used by determine which remote vehicle 106 sent the reply message.

The reply messages may be broadcast by the remote vehicles 106 such that the lead vehicle 104 and/or one or more of the other remote vehicles 106 receive the reply messages. For example, the remote vehicle 106C may communicate a reply message that is received by the lead vehicle 104, the remote vehicle 106A and/or 106B. The remote vehicles 106 that receive reply messages from one or more other remote vehicles 106 may store (e.g., record, log, or otherwise retain in an onboard memory) the status and identity of the other remote vehicles 106. With respect to the preceding example, one or more of the remote vehicles 106A and/or 106B may locally store the status and identity of the remote vehicle 106C, as described in more detail below.

In one embodiment, subsequent to communicating a command message, the lead vehicle 104 receives one or more reply messages from the remote vehicles 106. The lead vehicle 104 determines which remote vehicles 106 the lead vehicle 104 did not receive a reply message from. For example, the lead vehicle 104 may communicate a command message and receive reply messages from the remote vehicles 106A and 106C, but not from the remote vehicle 106B. The lead vehicle 104 can examine the identities in the reply messages that are received at the lead vehicle 104 in order to determine which remote vehicles 106 did not have reply messages received at the lead vehicle 104. The lead vehicle 104 can compare the identities in the received reply messages with a list, table, or other memory structure that includes the identities of the remote vehicles 106 in the vehicle consist 102 to determine which remote vehicles 106 did not have reply messages received by the lead vehicle 104.

When the lead vehicle 104 determines that reply messages are not received from one or more remote vehicles 106, the lead vehicle 104 can attempt to re-send the command messages one or more times. If the lead vehicle 104 still does not receive reply messages from the remote vehicles 106 in response to the initial command message and the re-sent command messages, the lead vehicle 104 can communicate a retry message to the remote vehicles 106. The retry message can include the directive of the command message and one or more missing reply identifiers. The missing reply identifiers can include the identities of the one or more remote vehicles 106 that did not have reply messages received at the lead vehicle 104. For example, if the lead vehicle 104 did not receive a reply message from the remote vehicle 106B, then the retry message may include the identity of the remote vehicle 106B.

The retry message is received by one or more of the remote vehicles 106. The remote vehicles 106 that receive the retry message can examine the retry message to determine if the one or more missing reply identifiers that are included in the retry message correspond to the identity and associated status of another remote vehicle 106 that is stored onboard the remote vehicle 106 that received the retry message. For example, if a first remote vehicle 106A stores the identity and status of the second and third remote vehicles 106B, 106C, and the lead vehicle 104 communicates a reply message including a missing reply identifier that identifies the second remote vehicle 106B, then the first remote vehicle 106A may determine that the lead vehicle 104 did not receive the reply message from the second remote vehicle 106B. The first remote vehicle 106A can then communicate the stored identity and status of the second remote vehicle 106B to the lead vehicle 104 in a repeat message. The repeat message is a message sent by one remote vehicle 106 that includes the identity and status of another remote vehicle 106.

In one embodiment, the lead and remote vehicles 104, 106 are assigned non-overlapping time slots during which the vehicles 104, 106 are allowed to communicate messages. For example, the lead vehicle 104 may be assigned a periodically repeating first time slot that occurs over a first time period, the first remote vehicle 106A is assigned a periodically repeating second time slot that occurs over a subsequent, second time period, the second remote vehicle 106B can be assigned a periodically repeating third time slot that occurs over a subsequent, third time slot, and so on. The vehicles 104, 106 may only communicate (e.g., transmit, broadcast, or a combination of transmitting and broadcasting) messages during the time slot assigned to each vehicle 104, 106. When a remote vehicle 106 communicates the status of another remote vehicle 106 in response to receiving a retry message from the lead vehicle 104, the remote vehicle 106 may communicate during its assigned time slot the status of the other remote vehicle 106 (whose status was stored onboard the remote vehicle 106 that communicates the status to the lead vehicle 104).

If the lead vehicle 104 receives the identity and status of the second remote vehicle 106B from the communication from the first remote vehicle 106A, then the lead vehicle 104 may remove the second remote vehicle 106B from the memory structure on the lead vehicle 104 that records which remote vehicles 106 that the lead vehicle 104 has not yet received reply messages since the command message was sent. The lead vehicle 104 may repeatedly communicate retry messages following the communication of the command message until the lead vehicle 104 receives reply messages or relayed messages from all the remote vehicles 106 in the vehicle consist 102 in one embodiment. Alternatively, the lead vehicle 104 may repeatedly communicate the retry messages following communication of the command message until the lead vehicle 104 receives reply messages or relayed messages from at least a previously designated number, fraction, or percentage of the total number of remote vehicles 104 in the vehicle consist 102.

In one embodiment, the lead vehicle 104 may communicate the retry message only a previously designated number of times before declaring a communication error. When a communication error occurs, the vehicle consist 102 may enter a communication error state and alert the operator of the lead vehicle 104 that communication has been lost with one or more remote vehicles 106. In response to this loss of communication alert, the operator may elect to slow or stop movement of the vehicle consist 102. Alternatively, the lead vehicle 104 may issue a new command message to the remote vehicles 106 when the communication error is declared.

In another embodiment, one or more of the remote vehicles 106 may include the status and identification of one or more other remote vehicles 106 in the reply message. For example, the remote vehicle 106A may communicate a reply message to the lead vehicle 104 that includes the status and identification of the remote vehicle 106B and the status and identification of the remote vehicle 106C in a single reply message that is sent from the remote vehicle 106A to the lead vehicle 104. As described above, the lead vehicle 104 communicates a command message that may be received by the remote vehicle 106A. The remote vehicle 106A can relay the command message to the remote vehicle 106B and also send a reply message to the lead vehicle 104 that includes the status and identifier of the remote vehicle 106B. The remote vehicle 106B and the remote vehicle 106C may or may not receive the relayed command message from the remote vehicle 106A. If the remote vehicle 106B or the remote vehicle 106C does not receive the relayed command message, then the same remote vehicle 106B or 106C does not send a reply message to the lead vehicle 104. Additionally or alternatively, the remote vehicle 106B or the remote vehicle 106C may receive the relayed command message, but the reply message sent from the remote vehicle 106B or from the remote vehicle 106C may not be received by the lead vehicle 104. The reply message may be received by the remote vehicle 106A.

After not receiving the reply message from one or more of the remote vehicles 106, the lead vehicle 104 can re-send a revised version of the command message. This revised version of the command message can include the same information as in the previously sent command message appended with the identifiers of those remote vehicles 106 that the lead vehicle 104 did not receive a reply message from. For example, if a previously sent command message instructed the remote vehicles 106 to switch to one or more designated throttle settings, then the re-sent command message may include the same instructions to switch to the same designated throttle settings, but also can include the unique identifiers of the remote vehicles 106B, 106C that the lead vehicle 104 did not receive a reply message from.

The remote vehicle 106A can receive the re-sent command message and respond by sending a reply message. The remote vehicle 106A also can store the identifiers of those remote vehicles 106B, 106C that are included in the re-sent command message received from the lead vehicle 104. The remote vehicles 106B, 106C can receive the re-send command message and respond by sending a reply message. The remote vehicle 106A can receive these reply messages and send an update message to the lead vehicle 104. The update message can include the statuses and identifiers of the remote vehicles 106B, 106C. For example, update message can be a single message sent by the remote vehicle 106A that includes the statuses and identities of the remote vehicles 106B, 106C identified in the re-sent command message. These statuses and identities can be in a single message, such as by being represented by data in different bits or bytes of a single transmitted message sent by the remote vehicle 106A. Additionally or alternatively, the statuses and identities can be in a single message sent by the remote vehicle 106A when the statuses and identifiers are sent in one or more transmissions generated by the remote vehicle 106A during the same time window that is assigned to the remote vehicle 106A for communicating messages. The remote vehicle 106A can concatenate the statuses and identifiers of multiple remote vehicles 106 that are identified by the lead vehicle 104 as being remote vehicles 106 that the lead vehicle 104 has not received a reply message from. The remote vehicle 106A can continue to concatenate the statuses and identifiers into a single message in response to future command messages sent from the lead vehicle 104 until the lead vehicle 104 notifies the remote vehicles 106 (e.g., in a subsequent command message or other message sent by the lead vehicle 104) that the statuses and identities of the remote vehicles 106 have all been received by the lead vehicle 104.

Figure 2A:
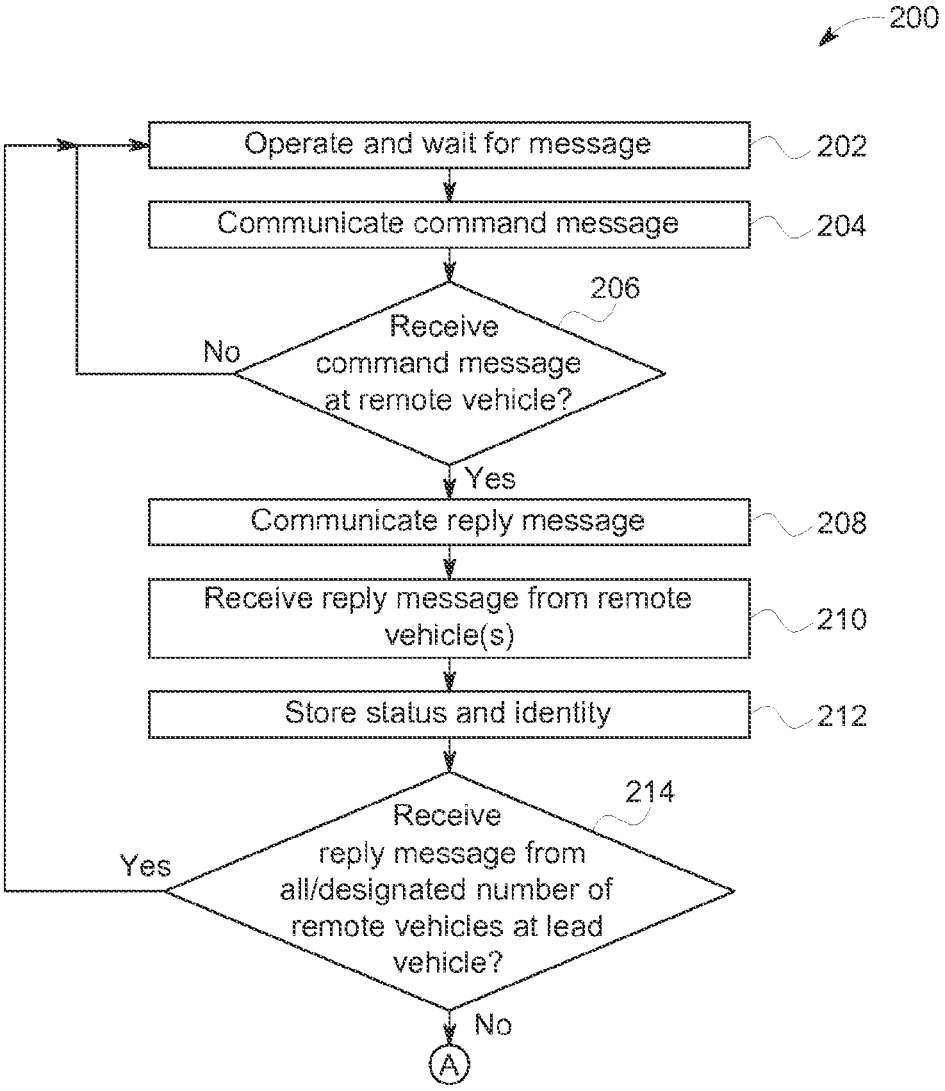
FIGS. 2A and 2B illustrate a flowchart of one embodiment of a method of communicating in the vehicle consist shown in FIG. 1.
Figure 2B:
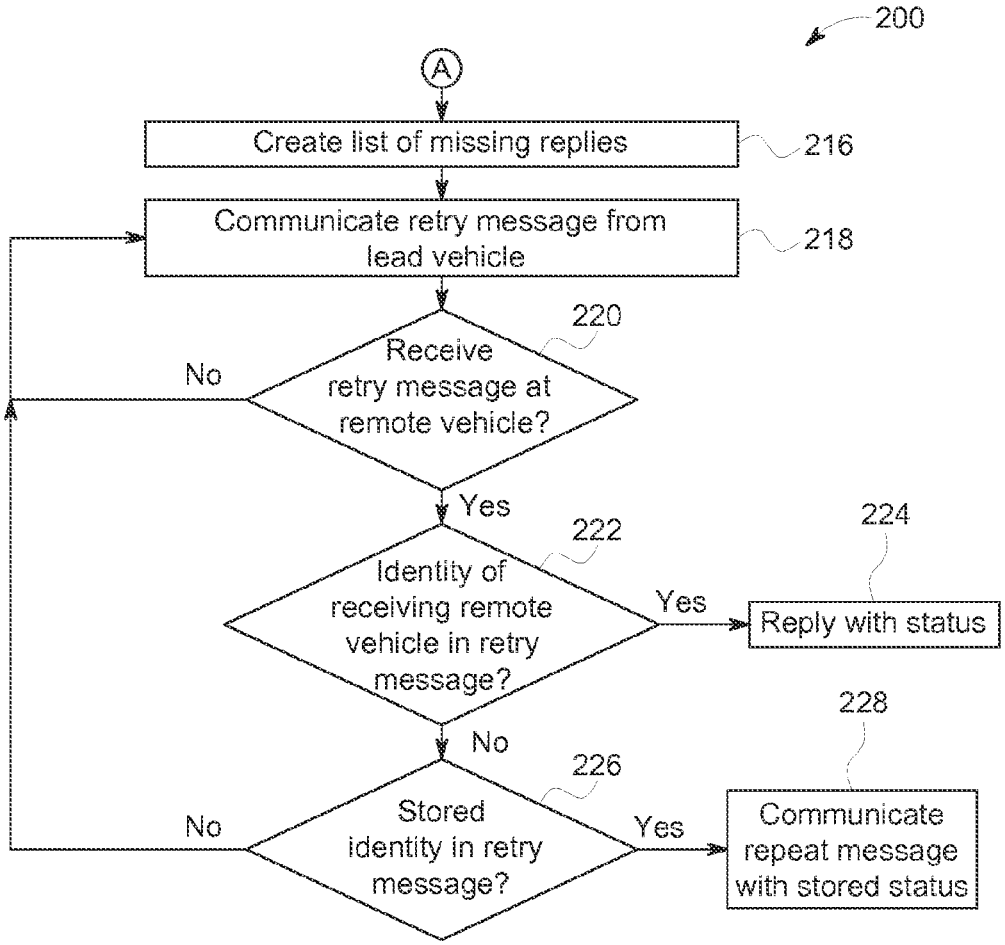

FIGS. 2A and 2B illustrate a flowchart of one embodiment of a method 200 of communicating in the vehicle consist 102 shown in FIG. 1. The method 200 may be used in conjunction with one or more embodiments of the communication system 100 shown in FIG. 1. For example, the method 200 may be used to communicate command messages from the lead vehicle 104 (shown in FIG. 1) to the remote vehicles 106 (shown in FIG. 1) and to handle the re-communication of commands and/or replies to ensure that all or at least a designated number of remote vehicles 106 receive the command messages. While the method 200 is described in connection with the vehicle consist 102 and communication system 100 shown in FIG. 1, alternatively, the method 200 may be used with another vehicle consist 102 and/or communication system 100.

Figure 3:
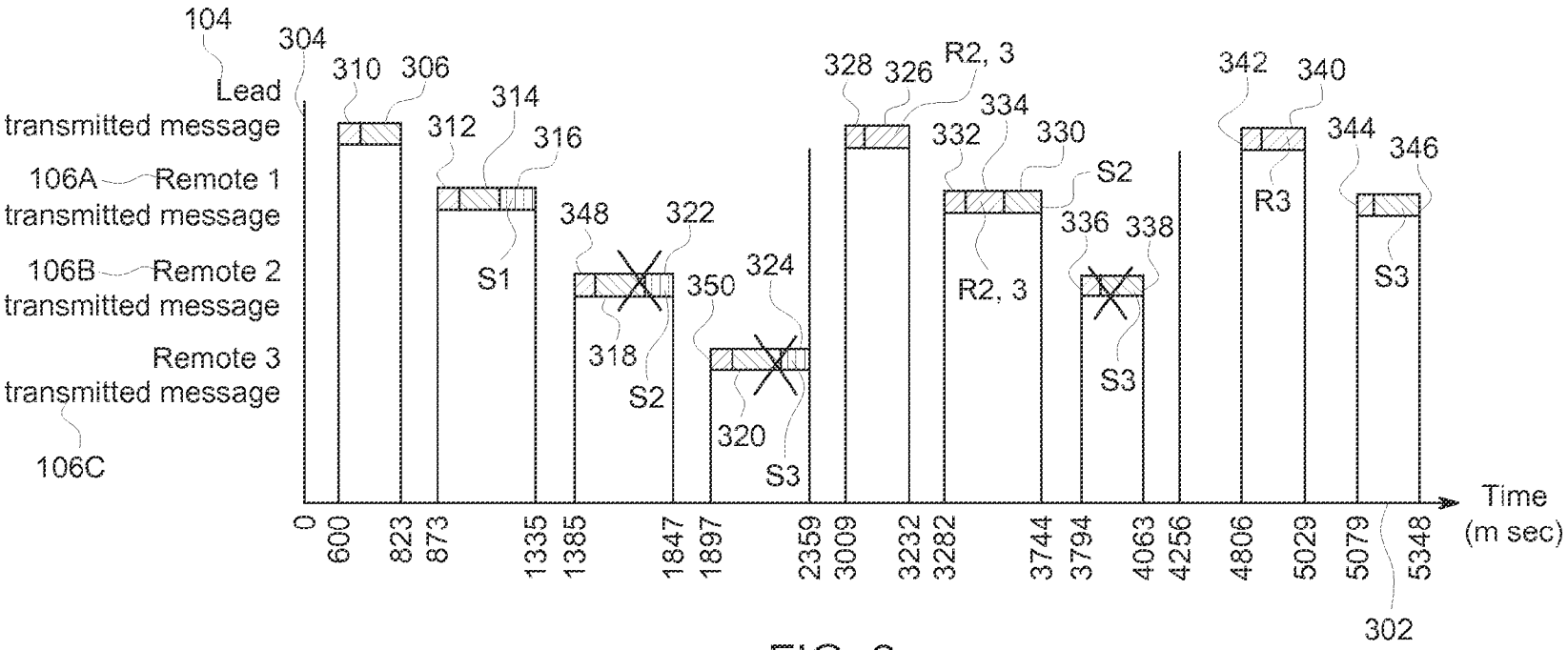
FIG. 3 illustrates an example of a timing diagram that is used to demonstrate one example of the method and use of the communication system shown in FIG. 1.

With continued reference to the method 200 shown in FIGS. 2A and 2B, FIG. 3 illustrates an example of a timing diagram 300 that is used to demonstrate one example of the method 200 and use of the communication system 100. The timing diagram 300 is shown alongside a horizontal axis 302 that is representative of time. The units and values of time shown for the horizontal axis 302 are provided merely as examples and are not intended to be limiting on all embodiments of the inventive subject matter described herein. A vertical axis 304 represents the different powered vehicles 104, 106 of the vehicle consist 102. For example, the events shown to the right of the corresponding vehicle 104, 106 in FIG. 3 occur at the time periods indicated by the horizontal axis 302. While the description herein focuses only on the lead vehicle 104 and the first, second, and third remote vehicles 106A, 106B, 106C, the description may apply to a smaller or larger number of remote vehicles 106.

With respect to the method 200 shown in FIG. 2A, at 202, the powered vehicles 104, 106 continue to operate to propel the vehicle consist 102 based on existing or previously communicated command message. For example, the remote vehicles 106 may continue to operate to propel the vehicle consist 102 based on a previously issue directive sent from the lead vehicle 104.

At 204 (shown in FIG. 2A), a command message 306 (shown in FIG. 3) is communicated by the lead vehicle 104 to the remote vehicles 106. As described above, the command message 306 may include a directive to the remote vehicles 106 to change tractive efforts and/or braking efforts supplied by the remote vehicles 106. In the embodiment shown in FIG. 3, a communication unit (e.g., communication unit 410 shown in FIG. 8) onboard the lead vehicle 104 is activated during a first activation time period 310 and communicates the command message 306.

With respect to the method 200 shown in FIG. 2A, at 206, a determination is made as to whether the command message 306 is received at a remote vehicle 106. For example, the remote vehicles 106 may determine whether the command message 306 communicated from the lead vehicle 104 is received. The remote vehicles 106 may determine that the command message 306 is received when the command message 306 is successfully received by the remote vehicles 106 (e.g., the entire command message 306 or at least enough of the command message 306 is received to permit the remote vehicle 106 to follow the directive contained in the command message 306). As a result, flow of the method 200 can proceed to 208. If no command message 306 is received or an insufficient amount of the command message 306 is received for the remote vehicle 106 to be able to understand and implement the directive contained in the command message 306, then the remote vehicles 106 may determine that no command message 306 is received. As a result, flow of the method 200 may return to 202. For example, the remote vehicles 106 may continue to operate and wait for a new command message 306 from the lead vehicle 104.

At 208 (shown in FIG. 2A), a reply message 316 (shown in FIG. 3) is communicated by the remote vehicles 106 that received the command message 306. As described above, the reply message 316 can include an identity of the remote vehicle 106 that is communicating the reply message 316 and a status of the remote vehicle 106. Additionally, in one embodiment, the remote vehicle 106 may re-communicate the command message 306 that is received from the lead vehicle 104 as a re-communicated command message 314 (shown in FIG. 3). The remote vehicles 106 may re-communicate the command message 306 in order to relay the command message 306 from the lead vehicle 104 among the remote vehicles 106 distributed along the length of the vehicle consist 102. In the illustrated example, the first remote vehicle 106A can include a communication unit (e.g., communication unit 410 shown in FIG. 8) that is activated during an activation time period 312 (shown in FIG. 3) and then communicates the re-communicated command message 314 and the reply message 316 after receiving the command message 306. The designation "S1" in the reply message 316 shown in FIG. 3 represents the status and identifier of the reply message 316 sent by the first remote vehicle 106A. Alternatively, the first remote vehicle 106A may not communicate the re-communicated command message 314.

At 210 (shown in FIG. 2A), the lead vehicle 104 receives the reply message 316 from one or more of the remote vehicles 106. For example, the communication unit 410 of the lead vehicle 104 can determine whether reply messages 316 sent by one or more of the remote vehicles 106 has been received during a designated time period following communication of the command message 306. The lead vehicle 104 can examine reply messages 316 that are received from the remote vehicles 106 and extract the identifiers from the received reply messages 316 (or, if the lead vehicle 104 does not detect receipt of any reply messages 316 during the designated time period, then the lead vehicle 104 may determine that no reply messages 316 have been received). The lead vehicle 104 can compare the extracted identities to a list, table, database, or other memory structure stored onboard the lead vehicle 104 (e.g., in a memory 412 shown in FIG. 8) and determine which remote vehicles 106 are not identified by the received reply messages 316.

With respect to the example shown in FIG. 3, each of the second and third remote vehicles 106B, 106C that received the command message 306 from the lead vehicle 104 activated respective communication units 410 (shown in FIG. 8) of the remote vehicles 106B, 106C during activation time periods 348, 350. These communication units 410 re-communicate the command message 306 from the lead vehicle 104 as re-communicated command messages 318, 320 and communicate reply messages 322, 324. The reply messages 322, 324 shown in FIG. 3 include designations "S2" and "S3" that represent the status and identity of each of the respective second and third remote vehicles 106B, 106C.

In the illustrated example of FIG. 3, the reply message 316 sent by the first remote vehicle 106A is received by the lead vehicle 104, but the reply messages 322, 324 sent by the second and third remote vehicles 106B, 106C, respectively, are not received by the lead vehicle 104, as indicated by the "X" shown over each of the reply messages 322, 324. As a result, at 210, the lead vehicle 104 determines that the reply message 316 from the first remote vehicle 106A is received, but not the reply messages 322, 324 from the second and third remote vehicles 106B, 106C. Consequently, the status of the first remote vehicle 106A is acquired by the lead vehicle 104, but not the statuses of the second or third remote vehicles 106B, 106C.

The flow of the method 200 shown in FIG. 2A may then proceed to 212, where the status and identity of the first remote vehicle 106A is stored. For example, the status and identity of the first remote vehicle 106A may be stored in an onboard memory (e.g., the memory 412) of the lead vehicle 104. Because the reply messages 322, 324 from the second and third remote vehicles 106B, 106C are not received by the lead vehicle 104, the statuses of the second and third remote vehicles 106B, 106C are not stored or recorded by the lead vehicle 104.

In one embodiment, the reply messages 316, 322, 324 are broadcast by the remote vehicles 106 such that one or more of the other remote vehicles 106 receive the reply message 316, 322, 324 that is communicated in response to the command message 306. For example, instead of communicating the reply message 316, 322, 324 so that only the lead vehicle 104 can receive the reply message 316, 322, 324, the remote vehicles 106 may communicate the reply messages 316, 322, 324 so that other remote vehicles 106 can receive the reply messages 316, 322, 324. A remote vehicle 106 that receives the reply message 316, 322, 324 of another remote vehicle 106 also may store the status and identity contained in the reply message 316, 322, 324. For example, the first remote vehicle 106A can receive the reply messages 322, 324 broadcast by the second and/or third remote vehicles 106B, 106C, the second remote vehicle 106B can receive the reply messages 316, 324 broadcast by the first and/or third remote vehicles 106A, 106C, and/or the third remote vehicle 106C can receive the reply messages 316, 322 broadcast by the first and/or second remote vehicles 106A, 106B. The remote vehicles 106 that receive reply messages 316, 322, 324 communicated by other remote vehicles 106 can store the statuses and identities included in the received reply messages 316, 322, 324. For example, the remote vehicles 106 can locally store the statuses and identities of the other remote vehicles 106 in the memory 412 that is onboard the remote vehicles 106.

At 214, a determination is made as to whether reply messages 316, 322, 324 are received by the lead vehicle 104 from all of the remote vehicles 106. If the reply messages 316, 322, 324 are received from all of the remote vehicles 106, then the lead vehicle 104 has the status and identities of the remote vehicles 106 and may not need to re-communicate the command message 306. As a result, flow of the method 200 can return to 202. On the other hand, if the reply messages 316, 322, 324 are not received from all of the remote vehicles 106, then the lead vehicle 104 may not have confirmation that all of the remote vehicles 106 received the command message 306. The lead vehicle 104 may need to re-communicate the command message 306 or at least the directive contained in the command message 306. As a result, flow of the method 200 continues to 216 in FIG. 2B.

Alternatively, a determination can be made at 214 as to whether reply messages 316, 322, 324 are received at the lead vehicle 104 from at least a designated number, fraction, or percentage of the remote vehicles 106, but not necessarily all of the remote vehicles 106. For example, for one or more command messages 306, the lead vehicle 104 may only need a designated number of and/or certain ones of the remote vehicles 106 to receive the command message 306, but not all of the remote vehicles 106. If the reply messages 316, 322, 324 are received from at least the designated number of the remote vehicles 106, then the lead vehicle 104 has the status and identities of the remote vehicles 106 and may not need to re-communicate the command message 306. As a result, flow of the method 200 can return to 202. On the other hand, if the reply messages 316, 322, 324 are not received from at least the designated number of remote vehicles 106, then the lead vehicle 104 may not have confirmation that a sufficient number of the remote vehicles 106 received the command message 306. The lead vehicle 104 may need to re-communicate the command message 306 or at least the directive contained in the command message 306. As a result, flow of the method 200 continues to 216 in FIG. 2B.

At 216, a list is created of the remote vehicles 106 from which the lead vehicle 104 did not receive reply messages 316, 322, 324 in response to the command message 306. The term "list" can include a sequence, table, database, or other memory structure that organizes information for later retrieval and/or updating. In one embodiment, the lead vehicle 104 compares the identities of the remote vehicles 106 from which the lead vehicle 104 received reply messages 316, 322, 324 and compares these identities to a list of the identities of the remote vehicles 104 in the vehicle consist 102. Based on this comparison, the lead vehicle 104 can determine which remote vehicles 106 have not communicated reply messages 316, 322, 324 or which remote vehicles 106 that the lead vehicle 104 has not received the reply message 316, 322, 324. These remote vehicles 106 can be referred to as "missing remote vehicles 106." The list of missing remote vehicles 106 can be created and stored onboard the lead vehicle 104, such as on the memory 412 of the lead vehicle 104. Alternatively, the list may be created and/or stored at an off-board location (e.g., a dispatch or other facility) and communicated to the lead vehicle 104. In the example shown in FIG. 3, the lead vehicle 104 creates a list having the identities of the second and third remote vehicles 106B, 106C, as the lead vehicle 104 has not received a reply message 316, 322, 324 from the second or third remote vehicles 106B, 106C.

At 218 (shown in FIG. 2B), a retry message is communicated from the lead vehicle 104. As described above, the retry message can be the same as or similar to the command message 306. For example, the retry message can include the directive that previously was communicated in the command message 306. The lead vehicle 104 communicates the retry message due to the failure of one or more (or more than a designated number) of the remote vehicles 106 to respond to the previously sent command message 306.

As shown in FIG. 3, a retry message 326 can be communicated by the lead vehicle 104, such as by the communication unit 410 of the lead vehicle 104. The communication unit 410 may be activated during an activation time period 328 and then the communication unit 410 may wirelessly communicate the retry message 326 and/or communicate the retry message 326 through one or more wired connections. In one embodiment, the retry message 326 includes the directive previously sent in the command message 306 and also includes the identities of one or more of the missing remote vehicles 106. For example, the retry message 326 can include the identities of the remote vehicles 106 from which a reply message 316, 322, 324 was not received responsive to the previous communication of the command message 306. The designation "R2, 3" in the retry message 326 in FIG. 3 indicates that the identities of the second and third remote vehicles 106B, 106C are included in the retry message 326. These identities can be included in the retry message 326 so as to notify the remote vehicles 106 that the lead vehicle 104 has not received reply messages 322, 324 from the remote vehicles 106 associated with the identities.

At 220 (shown in FIG. 2), a determination is made as to whether the retry message 326 is received at the remote vehicles 106. For example, the communication units 410 of the remote vehicles 106 may receive the retry message 326 from the lead vehicle 106. Alternatively, the communication units 410 of the remote vehicles 106 may determine that the retry message 326 is not received if no retry message 326 is received within a designated time period.

If the retry message 326 is received at a remote vehicle 106, then the remote vehicle 106 can examine the retry message 326 to determine if the remote vehicle 106 can provide the lead vehicle 104 with the status and identity of one or more of the remote vehicles 106 from which the lead vehicle 104 did not receive a reply message 316, 322, 324. As a result, flow of the method 200 may continue to 222. Otherwise, the method 200 may return to 218 if the retry message 326 is not received at the remote vehicle 106. For example, the lead vehicle 104 can re-send the retry message 326 after a designated time period of sending a previous retry message 326.

A remote vehicle 106 that receives the retry message 326 (e.g., a "receiving remote vehicle 106") examines the identities of the missing remote vehicles 106 included in the retry message 326. The receiving remote vehicle 106 can extract the identities of the missing remote vehicles 106 included in the retry message 326 to determine which of remote vehicles 106 that the lead vehicle 104 does not have the status. The receiving remote vehicle 106 can compare the identities of the missing remote vehicles 106 in the retry message 326 and compare these identities to the identities of the remote vehicles 106 that are stored by the receiving remote vehicle 106. For example, the receiving remote vehicle 106 can compare the identities in the retry message 326 with the identities stored in the memory 412 of the receiving remote vehicle 106. As described above, the identities stored in the memory 412 can include the identities of the remote vehicles 106 whose reply messages 316 were received by the receiving remote vehicle 106.

At 222, a determination is made as to whether a remote vehicle 106 that receives the retry message 326 is associated with an identity of a missing remote vehicle 106 included in the retry message 326. With respect to the example of FIG. 3, if the second or third remote vehicles 106B, 106C receive the retry message 326 with the identity of the second or third remote vehicle 106B, 106C, then the second or third remote vehicle 106B, 106C may determine that the remote vehicle 106B or 106C can respond with a status of the vehicle 106B or 106C. As a result, flow of the method 220 may continue to 224. On the other hand, if the statuses of the missing remote vehicles 106 in the retry message 326 do not match the identity of the remote vehicle 106 that receives the retry message 326, then the remote vehicle 106 may not respond with the status of the remote vehicle 106. As a result, flow of the method 200 may continue to 226.

At 224, the remote vehicle 106 that received the retry message 326 and that has the identity of the receiving remote vehicle 106 as a missing remote vehicle 106 can communicate a reply message to the lead vehicle 104. This reply message can include the identity and status of the receiving remote vehicle 106, similar to the reply message 316 described above.

At 226, a determination is made as to whether one or more of the identities of the missing remote vehicles 106 that are included in the retry message 326 match the identities stored in the memory 412 of the receiving remote vehicle 106. For example, in addition to or in place of determining whether the identity of the receiving remote vehicle 106 matches the identities of the missing remote vehicles 106 in the retry message 326, the receiving remote vehicle 106 may determine whether any of the statuses and identities stored onboard the receiving remote vehicle 106 match the identities in the retry message 326. As described above, the receiving remote vehicle 106 may locally store identities and statuses of other remote vehicles 106 based on reply messages 316, 322, 324 that are received by the receiving remote vehicle 106. If the identities of the missing remote vehicles 106 in the retry message 326 match the stored identities, then the receiving remote vehicle 106 may respond with the missing statuses and identities. As a result, flow of the method 200 may continue to 228. On the other hand, if the identifies of the missing remote vehicles 106 in the retry message 326 do not match the stored identifies, then the receiving remote vehicle 106 may not respond to the retry message 326. As a result, flow of the method 200 may return to 218. For example, the communication unit 410 of the remote vehicle 106 may wait for additional retry messages 326 to be sent by the lead vehicle 104. Alternatively or additionally, flow of the method 200 may return to 202 to wait for additional command messages 306 from the lead vehicle 104 or to 210 to wait for the receipt of reply messages 316, 322, 324 from other remote vehicles 106.

At 228, the receiving remote vehicle 106 communicates a repeat message to the lead vehicle 104 that includes the status and identity of at least one of the remote vehicles 106 identified by the retry message 326. With respect to the example shown in FIG. 3, the first remote vehicle 106A may receive the retry message 326 that includes the identities of the missing remote vehicles 106B, 106C. The first remote vehicle 106A compares these identities to the identities stored onboard the first remote vehicle 106A and determines that the first remote vehicle 106A has stored the statuses of the second and third remote vehicles 106B, 106C (based on previously receiving the reply messages 322, 324 from the second and third remote vehicles 106B, 106C, as described above). In response, the first remote vehicle 106A communicates a repeat message to the lead vehicle 104 that includes the status of the second and/or third remote vehicle 106B, 106C.

For example, as shown in FIG. 3, during an activation time period 332, the communication unit 410 of the first remote vehicle 106A turns on or is otherwise activated. The communication unit 410 of the first remote vehicle 106A receives the retry message 326 from the lead vehicle 106A. The first remote vehicle 106A then re-communicates the lead retry message 334 and communicates a repeat message 330 to the lead vehicle 104 that includes the status of the second remote vehicle 106B (as shown by the designation "S2" in FIG. 3).

In one embodiment, a remote vehicle 106 responds to the retry message 326 with the status of a single remote vehicle 106. For example, even though the first remote vehicle 106A has the statuses of both the second and third remote vehicles 106B, 106C stored onboard the first remote vehicle 106A, the first remote vehicle 106A responds to the retry message 326 with the stored status of the second remote vehicle 106B and not the status of any other remote vehicle 106. The remote vehicles 106 may respond to retry messages 326 or 334 with the status of a designated remote vehicle 106, such as the next remote vehicle 106 along the length of the vehicle consist 102. For example, the first remote vehicle 106A can respond with the status of the second remote vehicle 106B, the second remote vehicle 106B can respond with the status of the third remote vehicle 106C, and so on. Alternatively, the remote vehicles 106A may respond to a retry message 326 with several stored statuses of remote vehicles 106 that are identified by the retry message 326.

After communicating the repeat message 330 with the status of one or more remote vehicles 106 that are identified in the retry message 326 from the lead vehicle 104, the remote vehicle 106 that communicated the repeat message 330 may remove (e.g., delete) the status of the remote vehicle 106 identified by the retry message 326 from the onboard memory 412. For example, after the first remote vehicle 106A communicates the repeat message 330 with the stored status of the second remote vehicle 106B, the first remote vehicle 106A may delete the status of the second remote vehicle 106B from the memory 412 of the first remote vehicle 106A.

With respect to the third remote vehicle 106C in the example shown in FIG. 3, the third remote vehicle 106C may receive the retry message 326 or 334 that identifies the third remote vehicle 106C as a missing remote vehicle 106. As a result, the communication unit 410 of the third remote vehicle 106C activates during an activation time period 336 and communicates a reply message 338. As shown by the designation "S3" in FIG. 3, the reply message 338 includes the status of the third remote vehicle 106C.

In the example of FIG. 3, the lead vehicle 104 receives the repeat message 330 from the first remote vehicle 106A that includes the status of the second remote vehicle 106B, as described above. The lead vehicle 104 does not, however, receive the reply message 338 communicated by the third remote vehicle 106C, as shown by the "X" drawn over the reply message 338. After receiving the repeat message 330 from the first remote vehicle 106A, the communication unit 410 of the lead vehicle 104 may activate during an activation time period 342 and communicate another retry message 340 that includes the identity of the third remote vehicle 106C. The retry message 340 includes the identity of the third remote vehicle 106C because the lead vehicle 104 still does not have the status of the third remote vehicle 106C.

In the illustrated example, the first remote vehicle 106A receives the second retry message 340 and extracts the identity of the third remote vehicle 106C from the retry message 340. The first remote vehicle 106A examines the identities and statuses stored in the memory 412 of the first remote vehicle 106A (as described above), and determines that the first remote vehicle 106A has the status of the third remote vehicle 106C. For example, the communication unit 410 of the first remote vehicle 106A activates during an activation time period 344 and communicates a repeat message 346 to the lead vehicle 104 that includes the status of the third remote vehicle 106C. When the lead vehicle 104 receives the repeat message 346, the lead vehicle 104 has the statuses of the remote vehicles 106A, 106B, 106C.

While the description of the illustrated examples focuses on the first remote vehicle 106A communicating the statuses of the second and third remote vehicles 106B, 106C in the repeat messages 330, 346 to the lead vehicle 104, the description also may apply to the second, third, or other remote vehicle 106 in the vehicle consist 102. For example, the second remote vehicle 106B may communicate the statuses of the first, third, or other remote vehicle 106 in repeat messages when the second remote vehicle 106B receives retry messages from the lead vehicle 104.

In one embodiment of implementing the method 200 shown in FIGS. 2A and 2B with the system 100, the lead vehicle 104 communicates the command message 306 to the remote vehicles 106. The first remote vehicle 106A receives the command message 306 and communicates the status of the first remote vehicle 106A to the lead vehicle 104 in the reply message 316. The first remote vehicle 106A also repeats the command message 306 by communicating the command message 314. The second remote vehicle 106B receives the command message 306 and/or 314 and communicates the status of the second remote vehicle 106B to the lead vehicle 104 in the reply message 322. The second remote vehicle 106B also repeats the command message 306 or 314 by communicating another re-communicated command message 318. The third remote vehicle 106C receives the command message 306 and/or 314 and/or 318 and communicates the status of the third remote vehicle 106C to the lead vehicle 104 in the reply message 324. The third remote vehicle 106C also can repeat the command message 306 or 314 or 318 by communicating another re-communicated command message 320.

One or more of the remote vehicles 106 may receive the reply message 316, 322, 324 sent by one or more other remote vehicles 106. The remote vehicles 106 that receive the reply messages 316, 322, 324 can locally store the identity and associated status included in the reply messages 316, 322, 324. In one embodiment, each remote vehicle 106 may only store the status and identity of designated ones of the remote vehicles 106. For example, a remote vehicle 106 may only store the statuses and identities of those remote vehicles 106 that are downstream of the remote vehicle 106 along a direction of travel of the vehicle consist 102. Alternatively, the remote vehicles 106 may store the statuses and identities of other remote vehicles 106.

In one embodiment, if the lead vehicle 104 does not receive the reply messages 316, 322, 324 from each remote vehicle 106, then the lead vehicle 104 re-communicates the command message (e.g., in the retry message 326, 340). The lead vehicle 104 may delay re-communication of the command message by at least a designated amount to avoid interfering with the communication of reply messages 316, 322, 324 by the remote vehicles 106. This delay may be based on the number of remote vehicles 106 from which the lead vehicle 104 has not received a status and identity. For example, the communication unit 410 of the lead vehicle 104 may delay re-communication of the command message by a time period multiplied or otherwise increased by the number of remote vehicles 106 from which the lead vehicle 104 has not yet received a reply message 316, 322, 324. In one embodiment, the time delay is 512 msec times the number of remote vehicles 106 from which the lead vehicle 104 has not yet received a reply message 316, 322, 324.

The retry message 326 that is communicated by the communication unit 410 of the lead vehicle 104 may be modified from the previously communicated command message 306. For example, the retry message 326 may include one or more bits or bytes that are not included in the command message 306 that indicate that the retry message 326 is a retry message and not another command message. Such a bit or byte may be referred to as a "Retry Command/Repeat Status" byte. The remote vehicles 106 that receive the retry message 326 may identify this bit or byte in order to differentiate between new command messages 306 and retry messages 326. This bit or byte (or another bit or byte) in the retry message 326 may include an identifier bit or byte that indicates the remote vehicles 106 from which the lead vehicle 104 has not received reply messages 316, 322, 324.

In one embodiment, as each remote vehicle 106 receives the retry message 326 with the identified missing remote statuses, the receiving remote vehicle 106 communicates the status of the lowest missing remote vehicle 106 from the list of locally stored statuses and identities. By "lowest missing remote vehicle 106," it is meant that the remote vehicle 106 that receives the retry message 326 communicates the status of the remote vehicle 106 that is closest to the receiving remote vehicle 106 along the length of the vehicle consist 102, such as the next remote vehicle 106 located downstream from the receiving remote vehicle 106 along the length of the vehicle consist 102 in the direction of travel of the vehicle consist 102. Alternatively, the receiving remote vehicle 106 may communicate the status of another remote vehicle 106. The remote vehicles 106 may be assigned non-overlapping time slots during which the remote vehicles 106 are to communicate messages to the lead vehicle 104. The remote vehicle 106 that receives the retry message 326 may communicate the status of another remote vehicle 106 in the time slot that is assigned to the receiving remote vehicle 106. Alternatively, the remote vehicle 106 may communicate the status during another time slot.

As each remote vehicle 106 communicates the status of another remote vehicle 106 to the lead vehicle 104, the remote vehicle 106 that communicated the status will remove the status of the other remote vehicle 106 from the stored list of statuses that is onboard the remote vehicle 106 that communicated the status.

The communication unit 410 of the lead vehicle 104 may wait between communications of command messages 306 and retry messages 326 and 340 to receive the reply messages 316, 322, 324 and/or repeat messages 330 and 346 sent by the remote vehicles 106. In one embodiment, if the communication unit 410 of the lead vehicle 104 has not received the statuses of all of the remote vehicles 106 in the vehicle consist 102 after communicating the retry message 326 and 340 a number of times that is equivalent to the number of remote vehicles 104 in the vehicle consist 102, then the lead vehicle 104 may cease sending additional retry messages 326 and 340. For example, the lead vehicle 104 may send another command message 306 that does not include the "Retry Command/Repeat Status" bit or byte. The remote vehicles 106 that receive this new command message 306 can then respond by communicating a reply message 316, 322, 324 with the status of the remote vehicles 106 and may begin updating the locally stored list of statuses of other remote vehicles 106 (based on the reply messages 316, 322, 324 received by the other remote vehicles 106).

During the communication of retry messages 326 to the remote vehicles 106, the directives sent to the remote vehicles 106 from the lead vehicle 104 may need to change. For example, the tractive efforts, braking efforts, speed, power output, or the like, that is automatically or manually demanded from the remote vehicles 106 may change. The lead vehicle 104 can communicate another command message 306 that does not include the "Retry Command/Repeat Status" bit or byte. The remote vehicles 106 that receive this new command message 306 can then respond by communicating a reply message 316, 322, 324 with the status of the remote vehicles 106 and may begin updating the locally stored list of statuses of other remote vehicles 106 (based on the reply messages 316, 322, 324 received by the other remote vehicles 106).

Once the lead vehicle 104 has received the statuses of all of the remote vehicles 106, in one embodiment, the lead vehicle 104 can return to a normal periodic communication of the command messages 306. For example, if, prior to the communication of the retry messages 326, the lead vehicle 104 was communicating a new command message 306 (with the same or different directives for the remote vehicles 106) every 20 seconds (or other time period), then the lead vehicle 104 may return to this periodic communication of command messages 306 after receiving the statuses of all of the remote vehicles 10 in one embodiment.

Figure 4:
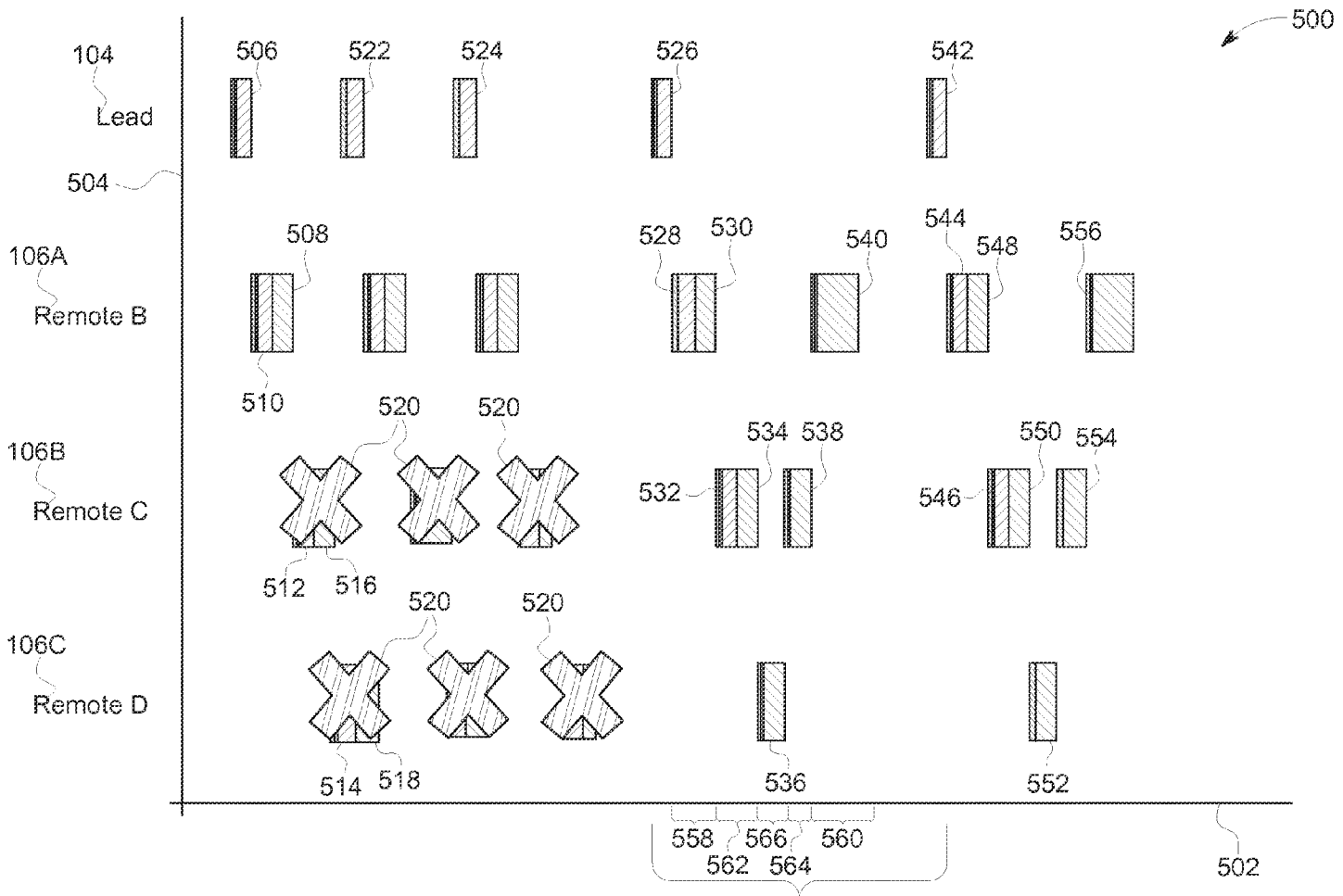
FIG. 4 illustrates another example of a timing diagram that can be used to demonstrate another example of use of the communication system.

FIG. 4 illustrates another example of a timing diagram 500 that can be used to demonstrate another example of use of the communication system 100. Similar to the timing diagram 300 shown in FIG. 3, the timing diagram 500 is shown alongside a horizontal axis 502 representative of time and a vertical axis 504 representative of the vehicles 104, 106 of the vehicle consist 102. For example, the events shown to the right of the corresponding vehicle 104, 106 in FIG. 4 occur at the time periods indicated by the horizontal axis 502. The term "Lead" represents the lead vehicle 104 and the terms "Remote B," "Remote C," and "Remote D" represent the remote vehicles 106A, 106B, and 106C, respectively. While the description herein focuses only on the lead vehicle 104 and the remote vehicles 106A, 106B, 106C, the description may apply to a smaller or larger number of remote vehicles 106.

In one embodiment, the lead vehicle 104 can only periodically send the command messages and retry messages. For example, the lead vehicle 104 may only be permitted to send the command messages, retry messages, or a combination of command and retry messages once every 1500 milliseconds (or another amount of time). The time period, that begins when the lead vehicle 104 is allowed to send messages and that ends before the next time that the lead vehicle 104 is permitted to again send messages, may define a message cycle 568 for the vehicle consist 102. The lead vehicle 104 may be unable to send multiple command messages or retry messages within a single message cycle in one embodiment. Alternatively, the lead vehicle 104 may communicate more than a single message during a single message cycle.

In operation, a command message 506 is communicated by the lead vehicle 104 to the remote vehicles 106 (e.g., at 204 in the method 200 shown in FIG. 2). As described above, the command message 506 may include a directive to the remote vehicles 106 to change tractive efforts and/or braking efforts supplied by the remote vehicles 106. A determination is made as to whether the command message 506 is received at a remote vehicle 106 (e.g., at 206 in the method 200). For example, the remote vehicles 106 may determine whether the command message 506 communicated from the lead vehicle 104 is received by the remote vehicles 106, similar to as described above. Each of the remote vehicles 106 may separately determine if the remote vehicle 106 received the command message 506.

If the command message 506 is successfully received by the remote vehicles 106 (e.g., the entire command message 506 or at least enough of the command message 506 is received to permit the remote vehicle 106 to follow the directive contained in the command message 506), then the remote vehicles 106 can perform the action directed by the command message 506, such as by changing throttle settings, brake settings, or a combination of both throttle settings and brake settings. But, if no command message 506 is received or an insufficient amount of the command message 506 is received for one or more of the remote vehicles 106 to be able to understand and implement the directive contained in the command message 506, then the one or more remote vehicles 106 may determine that no command message 506 is received. As a result, the remote vehicles 106 may continue to operate according to a currently implemented command (e.g., from a previously received command message or according to a default action) and wait for a new command message 506 from the lead vehicle 104.

In the illustrated example, all of the remote vehicles 106A, 106B, 106C received the command message 506. In one embodiment, the remote vehicle 106A may receive and then re-communicate the command message 506 as a re-communicated command message 510. The re-communicated command message 510 may include the same information or directives in the command message 506, with the re-communicated command message 510 being sent from the remote vehicle 106A instead of the lead vehicle 104.

The remote vehicle 106B may receive the re-communicated command message 510 from the remote vehicle 106A and then send this message in another re-communicated message 512. The re-communicated command message 512 may include the same information or directives in the command message 506, with the re-communicated command message 512 being sent from the remote vehicle 106B instead of the lead vehicle 104. The remote vehicle 106C may receive the re-communicated command message 512 from the remote vehicle 106B and then send this message to one or more other remote vehicles 106 in another re-communicated message 514. Alternatively, one or more of the remote vehicles 106B, 106C may receive the command message 506 from the lead vehicle 104 instead of receiving the re-communicated message 510 or 512.

Upon receipt of the respective command message 506, 510, 512, the remote vehicles 106 communicate reply messages (e.g., at 208 of the method 200). For example, the remote vehicle 106A communicates a reply message 508, the remote vehicle 106B communicates a reply message 516, the remote vehicle 106C communicates a reply message 518, and so on. The reply messages from the various remote vehicles 106 can include identity of the remote vehicle 106 that is communicating the reply message and a status of the same remote vehicle 106. These reply messages can be communicated from the remote vehicles 106 so that the lead vehicle 104 can confirm that the information (e.g., directive) in the command message 506 was received by the remote vehicles 106.

In the illustrated example, the reply messages 516 and 518 that are communicated by the remote vehicles 106B, 106C are not received by the lead vehicle 104. The "X" symbols 520 shown in FIG. 4 indicate that the associated reply messages are not received by the lead vehicle 104. As a result, the lead vehicle 104 cannot confirm whether the remote vehicles 106B, 106C received the directive included in the command message 506.

In the illustrated embodiment, in response to determining or assuming that one or more of the remote vehicles 106 did not receive the directive included in the command message 506 (e.g., when no reply message 516, 518 is received from the remote vehicles 106B, 106C), the lead vehicle 104 re-sends the instructions in the command message 506 one or more times in a repeated command message 522, 524. The illustrated embodiment shows the lead vehicle 104 re-sending the directive in the command message 506 two more times in the command messages 522, 524. Subsequent to sending each of the command messages 522, 524, the remote vehicles 106A-C receive the command messages 522, 524 and/or re-communicated command messages, and send reply messages in response thereto, similar to as described above. As shown in FIG. 4, the reply messages sent from the remote vehicles 106B, 106C in response to each of the command messages 522, 524 (or the corresponding re-sent command messages) are not received by the lead vehicle 104.

After a designated number of attempts at sending the instructions in one or more command messages without receiving reply messages from the remote vehicles in response thereto, the lead vehicle 104 may determine that a communication error has occurred. In the illustrated embodiment, the lead vehicle 104 determines that the communication error occurs when reply messages are not received from one or more (or at least a designated number) of the remote vehicles 106 after sending the instructions in two consecutive command messages (e.g., the messages 506, 522). Optionally, the lead vehicle 104 may determine that the communication error occurs after the reply messages are not received after the command message is sent a single time or re-sent by the lead vehicle 104 more than two times.

Once the communication error is identified, the lead vehicle 104 can identify which of the remote vehicles 106 that the lead vehicle 104 has not received a reply message from, as described above (e.g., at 210 of the method 200 in FIG. 2). In the illustrated example, the lead vehicle 104 determines that the lead vehicle 104 has not received reply messages from the remote vehicle 106B or the remote vehicle 106C. The lead vehicle 104 can examine reply messages that are received from the remote vehicles 106 within a designated time period of sending the command messages and extract the identifiers from the received reply messages (or, if the lead vehicle 104 does not detect receipt of any reply messages during the designated time period, then the lead vehicle 104 may determine that no reply messages have been received). The lead vehicle 104 can compare the extracted identities to a list, table, database, or other memory structure stored onboard the lead vehicle 104 (e.g., in a memory 412 shown in FIG. 8) and determine which remote vehicles 106 are not identified by the received reply messages 508, 516, 518.

The lead vehicle 104 can store the status and identity of the remote vehicles 106 from which reply messages are received, store the identity of the remote vehicles 106 from which the reply messages were not received, or store a combination thereof (e.g., at 212 in the method 200 shown in FIG. 2). The lead vehicle 104 can create a list of the remote vehicles 106 from which the lead vehicle 104 did not receive reply messages in response to the command message (e.g., at 216 in the method 200 shown in FIG. 2). The lead vehicle 104 can compare the identities of the remote vehicles 106 from which the lead vehicle 104 received reply messages to a list of the identities of the remote vehicles 104 in the vehicle consist. Based on this comparison, the lead vehicle 104 can determine which remote vehicles 106 have not communicated reply messages or which remote vehicles 106 that the lead vehicle 104 has not received the reply message. These remote vehicles 106 can be referred to as "missing remote vehicles 106." The list of missing remote vehicles 106 can be created and stored onboard the lead vehicle 104, such as on the memory 412 of the lead vehicle 104. Alternatively, the list may be created and/or stored at an off-board location (e.g., a dispatch or other facility) and communicated to the lead vehicle 104. In the example represented by FIG. 4, the lead vehicle 104 creates a list having the identities of the second and third remote vehicles 106B, 106C, as the lead vehicle 104 has not received a reply message from the second or third remote vehicles 106B, 106C.

The lead vehicle 104 communicates a retry message 526 that can be the same or similar to the command message 506, 522, 524 (e.g., at 218 of the method 200 shown in FIG. 2). The retry message 526 can include the directive that previously was communicated in the command message 506, 522, 524. Similar to as described above, the retry message 526 also can include the identities of one or more (or all) of the missing remote vehicles 106. For example, the retry message 526 can include the identities of the remote vehicles 106 from which a reply message was not received by the lead vehicle 104.

Similar to as described above, the remote vehicle 106A receives the retry message 526 and notes (e.g., identifies) the identities of the missing remote vehicles 106 in the retry message 526. The remote vehicle 106A can locally store these identities, such as in the memory device 412. The remote vehicle 106A can send a re-communicated retry message 528, similar to the command message 510 described above. For example, the remote vehicle 106A can repeat the information included in the retry message 526 in the re-communicated retry message 528. The re-communicated retry message 528 may include the directive (e.g., instructions) in the retry message 526 from the lead vehicle 104, as well as the identities of the missing remote vehicles 106. The remote vehicle 106A also may send a reply message 530 to the lead vehicle 104 to confirm receipt of the retry message 526, similar to as described above in connection with the reply message 508.

The remote vehicle 106B can receive the re-communicated retry message 528 (or the retry message 526 from the lead vehicle 104, or both of the retry messages 526, 528). The remote vehicle 106B can determine the identities of the missing remote vehicles 106 in the retry message 528 and locally store these identities, such as in the memory device 412. The remote vehicle 106B can send a re-communicated retry message 532, similar to the message 512 described above. The re-communicated retry message 532 may include the directive (e.g., instructions) in the retry message 526 from the lead vehicle 104, as well as the identities of the missing remote vehicles 106. The remote vehicle 106B also may send a reply message 534, similar to the reply message 516.

This reply message 534 from the remote vehicle 106B can be received by the remote vehicle 106A. The remote vehicle 106A can receive the reply message 534 and extract the identity and status of the remote vehicle 106B from the reply message 534. The remote vehicle 106A can at least temporarily store the identity and associated status of the remote vehicle 106B for later communication to the lead vehicle 104, as described below. The remote vehicle 106C receives the retry message 532 (or one or more of the retry message 526, the retry message 528, or both the retry messages 526, 528). In response, the remote vehicle 106C can communicate a reply message 536, similar to as described above in connection with the reply message 518.

As described above, the remote vehicles 106 may broadcast or otherwise communicate the reply messages so that one or more other remote vehicles 106 can receive the reply messages. In one aspect of the inventive subject matter described herein, one or more of the remote vehicles 106 can combine the statuses of one or more remote vehicles 106 and send these statuses back to the lead vehicle 104. For example, in response to the same instructions (e.g., directive) included in a command or retry message (e.g., the same command or retry message), a control unit (e.g., a control unit 402 shown in FIG. 8) of one or more of the remote vehicles 106 can receive and combine the statuses, identities, or a combination thereof of one or more missing remote vehicles 106 into a concatenated relayed message that is communicated to the lead vehicle 104. The remote vehicle 106 that sends or combines the status, identity, or both of one or more other remote vehicles 106 into the individual or concatenated relayed message for sending to the lead vehicle 104 may be referred to as a status-aggregating remote vehicle 106.

In the illustrated example, the reply message 536 sent by the missing remote vehicle 106C is received by the remote vehicle 106B. The remote vehicle 106B can examine the reply message 536 and determine that the remote vehicle 106C is one of the missing remote vehicles 106 identified in the retry message 528 received by the remote vehicle 106B. The remote vehicle 106B can then send the status and identity of the missing remote vehicle 106C in a relayed message 538. As shown in FIG. 4, the relayed message 538 may be communicated by the remote vehicle 106B after the reply message 534 is sent by the remote vehicle 106B and after the remote vehicle 106B receives the reply message 536 from the remote vehicle 106C.

The relayed message 538 can be received by the remote vehicle 106A. At this point in time, the remote vehicle 106A has received the status and identity of the missing remote vehicle 106B via the reply message 534 and has received the status and identity of the missing remote vehicle 106C via the relayed message 538. Optionally, the remote vehicle 106A may receive the status and identity of the remote vehicle 106C via the reply message 536. The remote vehicle 106A examines the list of missing remote vehicles 106 to determine which of the received reply and relayed messages that are received by the remote vehicle 106A include the statuses and identities of one or more of the missing remote vehicles 106. The remote vehicle 106A may extract the statuses and identities of the missing remote vehicles 106 that are received and combine the statuses and identities into a single concatenated relayed message 540 that is sent to the lead vehicle 104. For example, the remote vehicle 106A can combine the status and identity of the remote vehicle 106B (received by the remote vehicle 106A via the reply message 534) with the status and identity of the remote vehicle 106C (received by the remote vehicle 106A via the relayed message 538) into the relayed message 540.

The relayed message 540 may be a single message that includes the status and identity of multiple missing remote vehicles 106. For example, the statuses and identities of one or more missing remote vehicles 106 (other than or in addition to the remote vehicle 106 that is sending the concatenated relayed message 540) may be included in a single data packet communicated from the remote vehicle 106A (or another remote vehicle 106) to the lead vehicle 104. Alternatively, the statuses and identities of the one or more missing remote vehicles 106 can be included in one or more data packets having sequencing information in the header or footer of the data packets that indicate the data packets belong to the same sequence of data packets in a single message from the remote vehicle 106A to the lead vehicle 104. In another example, the statuses and identities can be combined into a single message to the lead vehicle 104 when these multiple statuses and identities of different remote vehicles 106 are communicated from a single remote vehicle 106 (e.g., the remote vehicle 106A) to the lead vehicle 104 during a single time slot assigned to the remote vehicle (e.g., the vehicle 106A). In another example, the statuses and identities can be combined into a single message to the lead vehicle 104 when these multiple statuses and identities of different remote vehicles 106 are communicated from a single remote vehicle 106 (e.g., the remote vehicle 106A) to the lead vehicle 104 during a single message cycle (e.g., before the next command or retry message is sent from the lead vehicle 104).

While the above examples focus on the remote vehicle 106A concatenating and sending multiple statuses of different missing remote vehicles 106 to the lead vehicle 104 in a single message 540, another remote vehicle 106 also or alternatively may concatenate and send these statuses to the lead vehicle 104 in a single message. For example, a remote vehicle 106 that is closer to the lead vehicle 104 than one or more missing remote vehicles 106 may combine and send the statuses and identities of these one or more missing remote vehicles 106 in a single concatenated relayed message. The concatenated relayed message may be sent to the lead vehicle 104 or to another remote vehicle 106 that is even closer to the lead vehicle 104. This closer remote vehicle 106 may then combine the statuses and identities in the concatenated relayed message that is received with one or more other received statuses and identities of missing remote vehicles 106, and send this combined information to the lead vehicle 104.

In one aspect, each of the remote vehicles 106 may only be allowed or capable of repeating (e.g., relaying in a relayed message or concatenated related message) the status and identity of another remote vehicle 106 (or multiple remote vehicles 106) that are farther from the lead vehicle 104 than the remote vehicle 106. For example, the remote vehicle 106A can relay the status and identity of any of the remote vehicles 106B, 106C to the lead vehicle 104, but the remote vehicle 106B can only relay the status and identity of the remote vehicle 106C but not that of the remote vehicle 106A. Similarly, the remote vehicle 106C may not relay the status or identity of any other remote vehicle 106 in the illustrated example.

The remote vehicles 106 can be assigned different, non-overlapping time slots during which the remote vehicles 106 can communicate the reply messages and relayed messages (including the concatenated relayed messages). For example, within each message cycle 568, the remote vehicle 106A may be assigned a first originating time slot 558 and a first relaying time slot 560. The remote vehicle 106B may be assigned a different, second originating time slot 562 and a different, second relaying time slot 564. The remote vehicle 106C may only be assigned a single, third originating time slot 566. As shown in FIG. 4, these time slots 558, 560, 562, 564, 566 may not overlap each other.

During the originating time slots 558, 562, 566, the remote vehicle 106 assigned to that time slot 558, 562, 566 can send the status and identity of that remote vehicle 106. The remote vehicles 106 may not be permitted to send the statuses or identities of any other remote vehicles 106 during the originating time slot 558, 562, 566 assigned to the respective remote vehicle 106. Instead, the remote vehicles 106 may send the statuses and identities of one or more other remote vehicles 106 during the relaying time slot 564, 560 assigned to the respective remote vehicle 106. For example, the remote vehicle 106A may only be allowed to send the concatenated relayed message 540 during the relaying time slot 560 assigned to the remote vehicle 106A and the remote vehicle 106B may only be allowed to send the relayed message 538 during the repeated time slot 564 assigned to the remote vehicle 106B. Because the remote vehicle 106C cannot relay the status or identifier of another remote vehicle 106 in the illustrated example, the remote vehicle 106C is not assigned a relaying time slot. Alternatively, the remote vehicle 106C may be assigned a relaying time slot during which the remote vehicle 106C can relay the status and identity of one or more other remote vehicles 106.

Once the lead vehicle 104 receives the concatenated relayed message 540, the lead vehicle 104 may have the statuses of all of the remote vehicles 106. The lead vehicle 104 may continue to send additional command messages 542 to the remote vehicles 106 as the vehicle consist 102 continues to travel. The lead vehicle 104 can continue to send the statuses and identities of the missing remote vehicles 106 (e.g., the vehicles 106 from which the lead vehicle 104 did not receive the status and identity directly, regardless to whether lead vehicle 104 has received the status and identity or received the status and identity indirectly, such as from another remote vehicle 106 via a relayed message or concatenated relayed message) in the additional command messages 542. The remote vehicles 106 can continue to repeat the information in the command messages 542 in re-communicated command messages 544, 546, send reply messages 548, 550, 552 in response to receiving the command messages 542, 544, 546, and send relayed messages 554 and concatenated relayed messages 556, similar to as described above.

The lead vehicle 104 may continue to send the statuses and identities of the missing remote vehicles 106 in the command messages unless and until reply messages are directly received from the remote vehicles 106. For example, as long as the status and identity of one or more of the remote vehicles 106 are relayed from another remote vehicle 106 to the lead vehicle 104 (instead of the lead vehicle 104 receiving the reply messages directly from each of the remote vehicles 106 without the information in the reply messages being relayed by another remote vehicle 106), the lead vehicle 104 continues to identify the missing remote vehicles 106 in the command and retry messages. Once the lead vehicle 104 receives the statuses and identities directly from the remote vehicles 106 via reply messages from the remote vehicles 106, the lead vehicle 104 may stop identifying any missing remote vehicles 106 in subsequent command messages. In the illustrated example, the lead vehicle 104 may receive the reply message 548 from the remote vehicle 106A, the reply message 550 from the remote vehicle 106B, and the reply message 552 from the remote vehicle 106C. While the remote vehicle 106B may relay the status and identity of the remote vehicle 106C in the relayed message 554 and the remote vehicle 106A may relay the statuses and identities of the remote vehicles 106B, 106C in the concatenated relayed message 556, the lead vehicle 104 may receive the reply messages 548, 550, 552 directly from the respective remote vehicles 106A, 106B, 106C. As a result, the lead vehicle 104 stops identifying the missing remote vehicles in subsequent command messages and terminates the communication error that previously was identified. The lead vehicle 104 may then return to sending the command messages to the remote vehicles 106.

Figure 5:
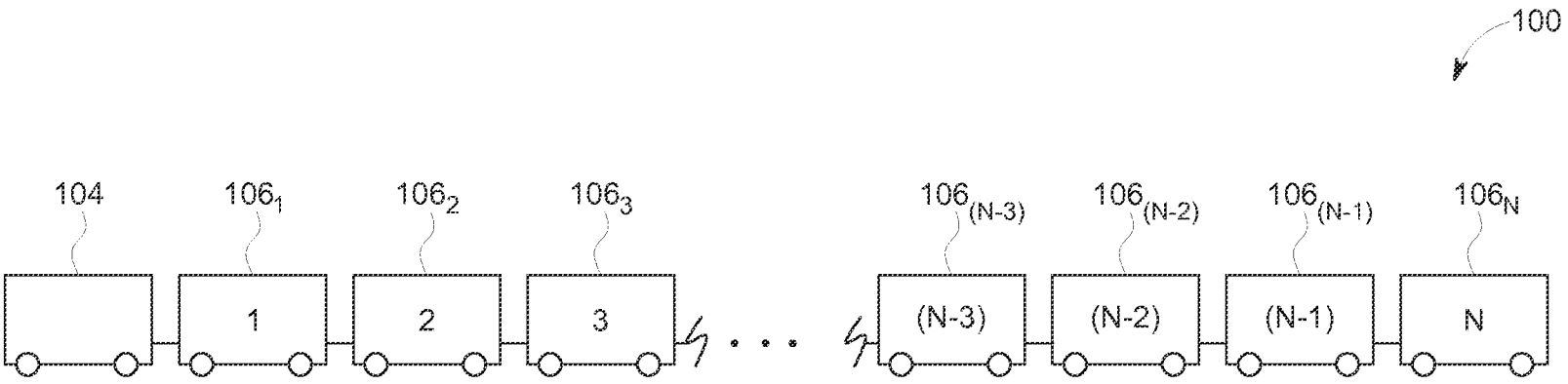
FIG. 5 illustrates the vehicle consist in accordance with one embodiment.

FIG. 5 illustrates the vehicle consist 102 in accordance with one embodiment. In the illustrated example, the vehicle consist 102 includes several more propulsion-generating vehicles 104, 106 than is shown in FIG. 1. The non-propulsion generating vehicles are not shown in FIG. 5, but may be located between two or more of the propulsion-generating vehicles 104, 106. The consist 102 shown in FIG. 5 includes the lead vehicle 104 and several remote vehicles 106. The total number of remote vehicles 106 is represented by the number N. The remote vehicles 106 are identified by different numbers, such as 1, 2, 3, (N−3), (N−2), (N−1), and N to indicate the different remote vehicles 106. The reference numbers for the different remote vehicles 106 include these same numbers (e.g., $\mathbf{106}_1$, $\mathbf{106}_2$, $\mathbf{106}_3$, $\mathbf{106}_{(N-3)}$, $\mathbf{106}_{(N-2)}$, $\mathbf{106}_{(N-1)}$, $\mathbf{106}_N$).

In one embodiment, each of the remote vehicles 106 may send a concatenated relayed message that includes the status and identity of all missing remote vehicles 106 located farther from the lead vehicle 104 than the remote vehicle 106 that is sending the concatenated relayed message. For example, in the vehicle consist 102 shown in FIG. 5, the first remote vehicle $\mathbf{106}_1$ can send an individual or concatenated relayed message that includes the statuses of one or more of the remote vehicles $\mathbf{106}_2$, $\mathbf{106}_3$, $\mathbf{106}_{(N-3)}$, $\mathbf{106}_{(N-2)}$, $\mathbf{106}_{(N-1)}$, $\mathbf{106}_N$. Optionally, the first remote vehicle $\mathbf{106}_1$ can send both an individual message and a concatenated relayed message.

The second remote vehicle $\mathbf{106}_2$ can send an individual and/or concatenated relayed message that includes the statuses of one or more of the remote vehicles $\mathbf{106}_3$, $\mathbf{106}_{(N-3)}$, $\mathbf{106}_{(N-2)}$, $\mathbf{106}_{(N-1)}$, $\mathbf{106}_N$. The third remote vehicle $\mathbf{106}_3$ can send an individual and/or concatenated relayed message that includes the statuses of one or more of the remote vehicles $\mathbf{106}_{(N-3)}$, $\mathbf{106}_{(N-2)}$, $\mathbf{106}_{(N-1)}$, $\mathbf{106}_N$. The (N−3) remote vehicle $\mathbf{106}_{(N-3)}$ can send an individual and/or concatenated relayed message that includes the statuses of one or more of the remote vehicles $\mathbf{106}_{(N-2)}$, $\mathbf{106}_{(N-1)}$, $\mathbf{106}_N$. The (N−2) remote vehicle $\mathbf{106}_{(N-2)}$ can send an individual and/or concatenated relayed message that includes the statuses of one or more of the remote vehicles $\mathbf{106}_{(N-1)}$, $\mathbf{106}_N$. Because the remote vehicle $\mathbf{106}_{(N-1)}$ includes only a single other remote vehicle $\mathbf{106}_N$ located farther from the lead vehicle 104, the remote vehicle $\mathbf{106}_{(N-1)}$ does not send any concatenated relayed message to the lead vehicle 104, but can send an individual relayed message. Also, because there are no other remote vehicles 106 located farther from the lead vehicle 104 than the remote vehicle $\mathbf{106}_N$, the remote vehicle $\mathbf{106}_N$ may not send any individual or concatenated relayed message to the lead vehicle 104. Alternatively, one or more of the remote vehicles 106 may send an individual or concatenated relayed message that includes the status and identity of a remote vehicle 106 that is located closer to the lead vehicle 104.

Figure 6:
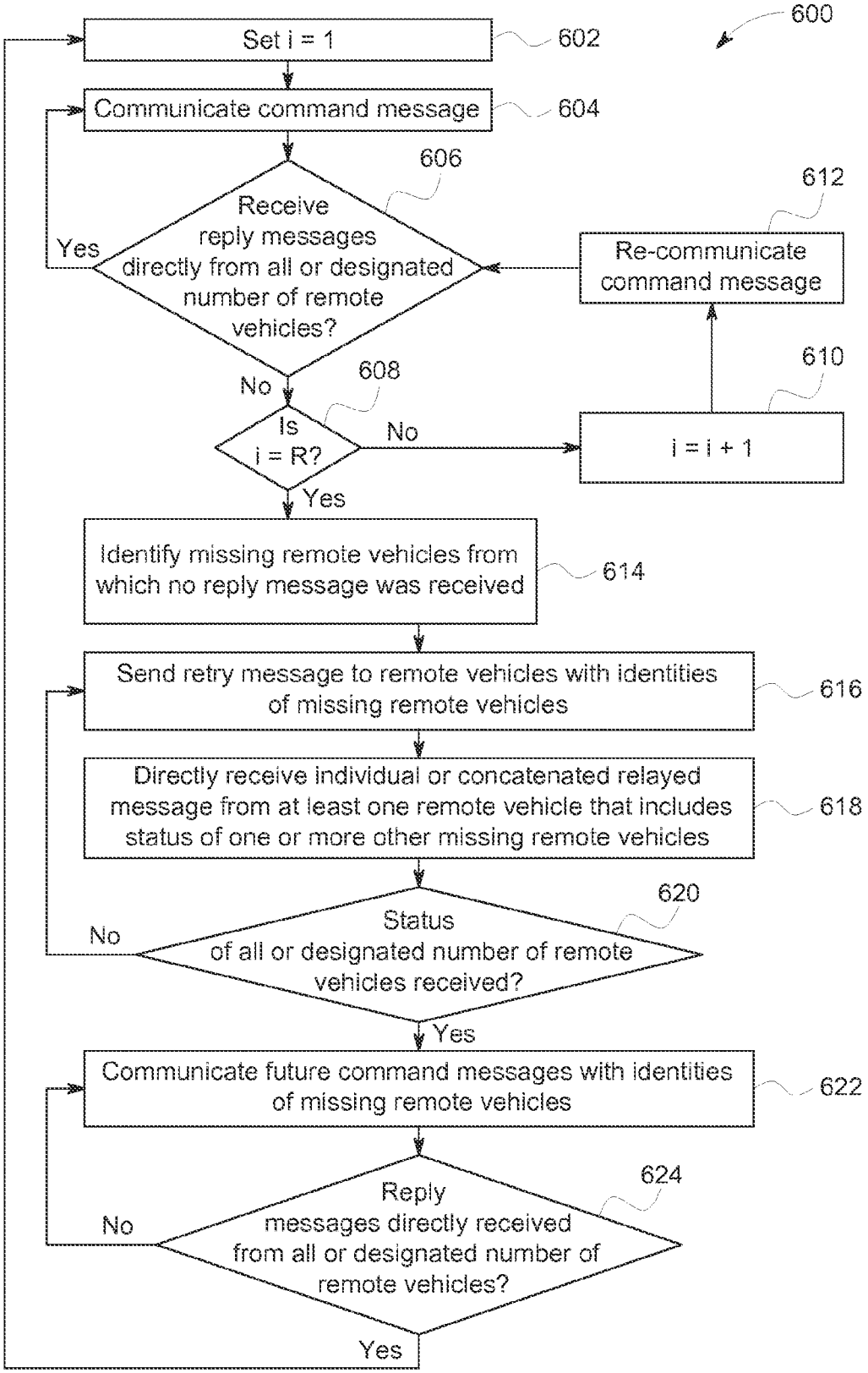
FIG. 6 is a flowchart of a method for communicating in a vehicle consist in accordance with one embodiment.

FIG. 6 is a flowchart of a method 600 for communicating in a vehicle consist in accordance with one embodiment. The method 600 may be used to control operations of the remote vehicles 106 in the vehicle consist 102 shown in FIG. 1 from the lead vehicle 104. At 602, the value of a command message retry variable i is set to zero (or another value). This variable may be set to a value that indicates that a new or different command message is being sent from the lead vehicle 104 to the remote vehicles 106. For example, each time a different directive is sent to the remote vehicles 106, this variable may be re-set to zero or another value.

At 604, a command message is sent from the lead vehicle 104 to the remote vehicles 106, as described above. At 606, a determination is made as to whether reply messages were received from all or at least a designated number of the remote vehicles 106 in the consist 102. If not, then not all or at least the designated number of the remote vehicles 106 may have received the command message. As a result, the command message may need to be re-sent to ensure that all or at least the designated number of remote vehicles 106 receives the command message. Flow of the method 600 may proceed to 608 in order to determine if the command message already has been repeated a designated number of times to the remote vehicles 106.

For example, at 608, a comparison is made between the retry variable i and a designated limit on the number of retry attempts (R) The retry variable i can represent the number of times that the lead vehicle 104 has attempted to send the command message to the remote vehicles 106 and the limit (R) can represent the total number of times that the command message is to be sent and re-sent before proceeding with one or more of the remote vehicles 106 sending the concatenated relayed messages described above. If the retry variable i is equal to the limit (R), then the lead vehicle 104 may stop repeating the sending of the same command message and may begin identifying the missing remote vehicles 106 from which no reply messages are received. As described above, the lead vehicle 104 can begin identifying these missing remote vehicles 106 so that one or more other remote vehicles 106 can send the individual or concatenated relayed messages with the statuses of one or more of the missing remote vehicles 106. Sending the concatenated relayed messages can significantly reduce the amount of time needed for the lead vehicle 104 to confirm receipt of the instructions in the command message by the remote vehicles 106 relative to the remote vehicles 106 only relaying the status of a single other remote vehicle 106 in a relay message. In the illustrated example, if the retry variable i is equal to the limit (R), then the method 600 may proceed to 614 to cause the relayed concatenated messages to be sent by one or more of the remote vehicles 106.

On the other hand, if the retry variable i is less than the limit (R), then the lead vehicle 104 may continue repeating the sending of the same command message before having the remote vehicles 106 begin sending the concatenated relayed messages. As a result, flow of the method 600 may proceed from 608 to 610. At 610, the value of the retry variable i is increased (e.g., by one, although another value may be used) and the method 600 proceeds to 612, wherein the command message is re-sent by the lead vehicle 104 to the remote vehicles 106. Flow of the method 600 may return to 606, where the determination of whether reply messages are received from all or at least the designated number of remote vehicles 106 is made again. The method 600 may proceed in a loop among the operations of 606, 608, 610, 612 until reply messages are received from all or at least the designated number of remote vehicles 106, or until the limit (R) on the number of retries in sending the command message has been reached.

At 614, the remote vehicles 106 from which the reply messages were not received are identified. For example, the control unit 402 (shown in FIG. 8) onboard the lead vehicle 104 may compare the identities of the remote vehicles 106 from which the reply messages were received to a list of the remote vehicles 106 in the vehicle consist 102 to determine which remote vehicles 106 that a reply message was not received from.

At 616, a retry message is sent to the remote vehicles 106 from the lead vehicle 104. As described above, this retry message may include the instructions (e.g., directives) from the command message, along with identities of the missing remote vehicles 106 that the lead vehicle 104 did not receive a reply message from.

At 618, the lead vehicle 104 may receive at least one individual or concatenated relayed message from a remote vehicle 106 that includes the statuses of one or more of the missing remote vehicles 106. For example, one or more of the remote vehicles 106 may send a single individual or concatenated message in response to the reply message that includes the statuses of one or more of the missing remote vehicles 106 combined together in the single message, as described above. One or more of the remote vehicles 106 may directly sent reply messages to the lead vehicle 104 in response to the retry message.

At 620, a determination is made as to whether the statuses of all or at least the designated number of remote vehicles 106 has been received at the lead vehicle 104 in response to the retry message. If these statuses have been received from all or at least the designated number of the remote vehicles 106, then the lead vehicle 104 can confirm that all or at least the designated number of remote vehicles 106 received the instructions in the retry message. As a result, flow of the method 600 can proceed to 622. On the other hand, if these statuses have not been received from all or at least the designated number of the remote vehicles 106, then the lead vehicle 104 cannot confirm that all or at least the designated number of remote vehicles 106 received the instructions in the retry message. As a result, flow of the method 600 can return to 616 so the lead vehicle 104 can re-send the retry message. The lead vehicle 104 may attempt a designated number of attempts at re-sending the retry message without receiving the statuses of all or at least the designated number of the remote vehicles 106 before notifying an operator of the vehicle consist 102 of a communication interruption with the indicated vehicle 106, automatically shutting down the indicated vehicle 106 or vehicle consist 102, automatically braking the vehicle consist 102, or taking another remedial action.

At 622, future (e.g., subsequent) command messages sent by the lead vehicle 104 are sent with the identities of the missing remote vehicles 106. For example, after confirming that statuses of all or at least the designated number of remote vehicles 106 were received in reply messages directly received from the remote vehicles 106, via one or more relayed concatenated messages, or by a combination of the reply messages and the concatenated relayed messages, the lead vehicle 104 may continue to send subsequent command messages (which may be different from previous command messages) with the identities of the same missing remote vehicles 106. The lead vehicle 104 may continue to include these identities so that the reply messages and relayed concatenated messages continue to be received from the remote vehicles 106.

At 624, a determination is made as to whether reply messages are directly received at the lead vehicle 104 from all or at least the designated number of remote vehicles 106. If the reply messages are directly received from the remote vehicles 106, then the lead vehicle 104 may no longer need one or more of the remote vehicles 106 to generate and send the concatenated relayed messages to ensure that the lead vehicle 104 receives the statuses of all or at least the designated number of remote vehicles 106. As a result, flow of the method 600 can return to 602. On the other hand, if the lead vehicle 104 is still not directly receiving the reply messages directly from all or at least the designated number of remote vehicles 106, then the lead vehicle 104 may continue to need one or more of the remote vehicles 106 to continue sending the concatenated relayed messages to ensure that the lead vehicle 104 receives the statuses of all or at least the designated number of remote vehicles 106. As a result, flow of the method 600 may return to 622.

Figure 7:
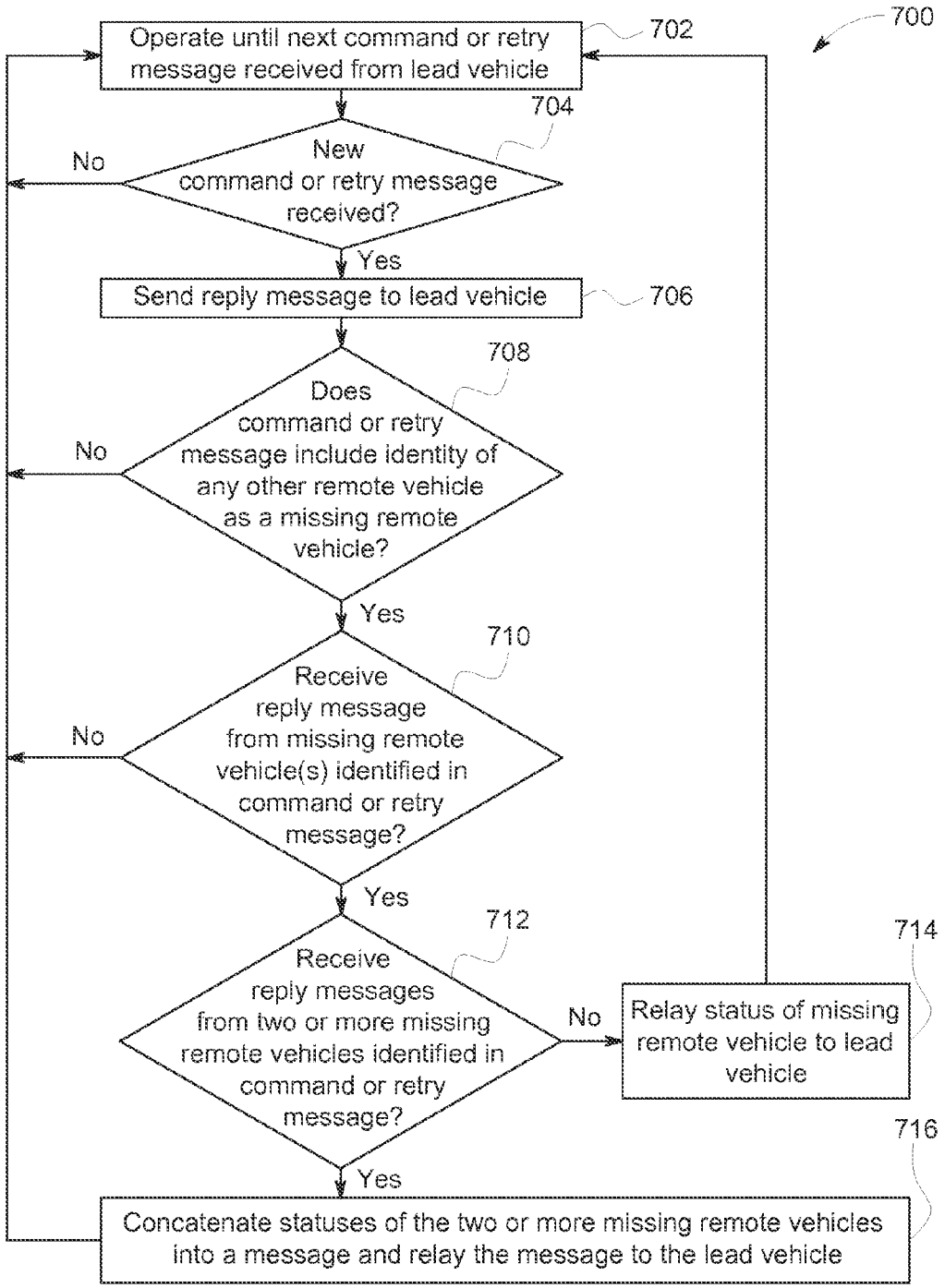
FIG. 7 is a flowchart of a method for communicating in a vehicle consist in accordance with one embodiment.

FIG. 7 is a flowchart of a method 700 for communicating in a vehicle consist in accordance with one embodiment. The method 700 may be used to control operations of at least one of the remote vehicles 106 in the vehicle consist 102. At 702, the remote vehicle 106 continues to operate according to a previously received command message from the lead vehicle 104 until a new (e.g., different) command message or retry message is received from the lead vehicle 104. At 704, a determination is made as to whether a new or different command or retry message is received. If so, the remote vehicle 106 may need to respond to the command or retry message and, as a result, flow of the method 700 can proceed to 706. Otherwise, flow of the method 700 can return to 702 so the remote vehicle 106 can continue to operate according to the previously received command message or retry message.

At 706, a reply message is sent by the remote vehicle 106. For example, the remote vehicle 106 may broadcast (or otherwise communicate) a reply message in response to receiving the command or retry message from the lead vehicle 104. As described above, this reply message may include the identity and status of the remote vehicle 106 that is sending the reply message.

At 708, a determination is made as to whether the command message or retry message received from the lead vehicle 104 includes the identity of any other remote vehicle 106. For example, the command or retry message may include the identity of one or more missing remote vehicles 106, as described above. If no missing remote vehicles 106 are identified in the command or retry message, then the remote vehicle 106 may not need to relay the status of any other remote vehicles 106 to the lead vehicle 104. As a result, flow of the method 700 may return to 702.

On the other hand, if one or more missing remote vehicles 106 are identified in the command or retry message, then the remote vehicle 106 that received the command or retry message may need to relay the status or statuses of one or more of the missing remote vehicles 106 identified in the command or retry message. As a result, flow of the method 700 continues to 710.

At 710, a determination is made as to whether the remote vehicle 106 has received reply messages from one or more of the missing remote vehicles 106 identified in the command or retry message. If so, then the remote vehicle 106 may need to relay the statuses of the one or more missing remote vehicles 106 to the lead vehicle 104 to ensure that the lead vehicle 104 receives the statuses of the missing remote vehicles 106. Accordingly, flow of the method 700 may proceed to 712. On the other hand, if the remote vehicle 106 has not received reply messages from any of the missing remote vehicles 106, then the remote vehicle 106 may not have the statuses of these missing remote vehicles 106 to relay to the lead vehicle 104. Consequently, flow of the method 700 may return to 702.

At 712, a determination is made as to whether the remote vehicle 106 has received reply messages from two or more of the missing remote vehicles 106 identified in the command or retry message. For example, similar to at 710, the remote vehicle 106 determines if the statuses of missing remote vehicles 106 has been received. If the statuses of two or more of the missing remote vehicles 106 has been received, then the remote vehicle 106 can include these multiple statuses into a single message that is sent (e.g., directly sent and not via another vehicle 106) to the lead vehicle 104. If reply messages from two or more of the missing remote vehicles 106 have been received at the remote vehicle 106, then flow of the method 700 can continue to 716. On the other hand, if only one reply message has been received from a single missing remote vehicle 106, then flow of the method 700 can continue to 714.

At 714, the remote vehicle 106 can relay the status of one other missing remote vehicle 106 to the lead vehicle 104. For example, the remote vehicle 106 can send a relayed message to the lead vehicle 104 that includes the status of a single missing remote vehicle 106. Flow of the method 700 may then return to 702.

At 716, however, the remote vehicle 106 can combine the statuses of two or more of the missing remote vehicles 106 into a single message and send this message directly to the lead vehicle 104. For example, the remote vehicle 106 can generate the concatenated relayed message described above and send this message to the lead vehicle 104. Optionally, the remote vehicle 106 can send the concatenated relayed message to one or more other remote vehicles 106 before the statuses of the missing remote vehicles 106 in the concatenated relayed message are sent to the lead vehicle 104. For example, one other remote vehicle 106 can receive the concatenated relayed message, combine the statuses of the missing remote vehicles 106 in the concatenated relayed message with the status of one or more additional missing remote vehicles 106, and send a concatenated relayed message to the lead vehicle 104 that includes all of these statuses. Flow of the method 700 may then return to 702.

Figure 8:
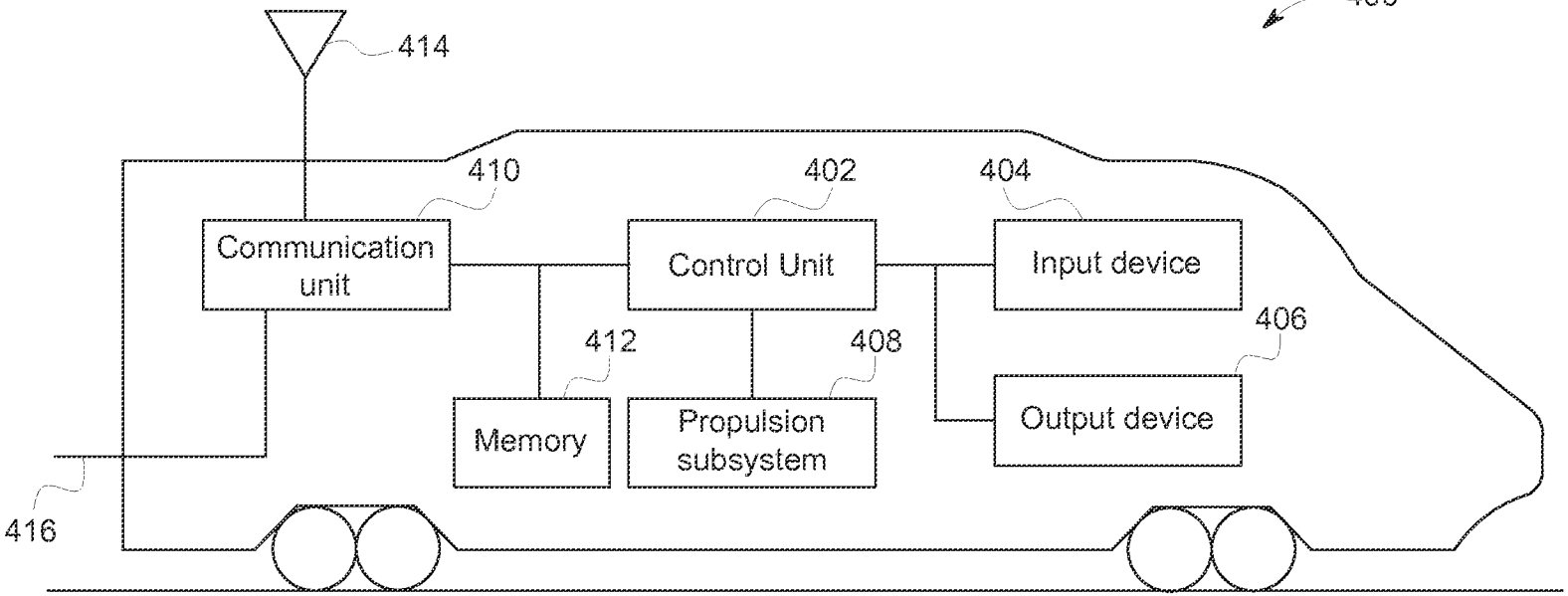
FIG. 8 is a schematic diagram of a powered vehicle in accordance with one embodiment.

FIG. 8 is a schematic diagram of a propulsion-generating vehicle 400 in accordance with one embodiment. The vehicle 400 may represent one or more of the vehicles 104, 106 shown in FIG. 1. The vehicle 400 includes a communication system that includes a control unit 402 that controls operations of the vehicle 400. The control unit 402 can include or represent one or more hardware circuits or circuitry that include, are connected with, or that both include and are connected with one or more processors, controllers, or other hardware logic-based devices. The control unit 402 is connected with an input device 404 and an output device 406. The control unit 402 can receive manual input from an operator of the powered vehicle 400 through the input device 404, such as a touchscreen, keyboard, electronic mouse, microphone, or the like. For example, the control unit 402 can receive manually input changes to the tractive effort, braking effort, speed, power output, and the like, from the input device 404. The control unit 402 can present information to the operator using the output device 406, which can represent a display screen (e.g., touchscreen or other screen), speakers, printer, or the like. For example, the control unit 402 can present the identities and statuses of the remote vehicles 106, identities of the missing remote vehicles 106 (e.g., those remote vehicles 106 from which the lead vehicle 104 has not received the status), contents of one or more command messages, retry messages, reply messages, repeat messages, or the like.

The control unit 402 is connected with a propulsion subsystem 408 of the powered vehicle 400. The propulsion subsystem 408 provides tractive effort and/or braking effort of the powered vehicle 400. The propulsion subsystem 408 may include or represent one or more engines, motors, alternators, generators, brakes, batteries, turbines, and the like, that operate to propel the powered vehicle 400 under the manual or autonomous control that is implemented by the control unit 400. For example, the control unit 400 can generate control signals autonomously or based on manual input that is used to direct operations of the propulsion subsystem 408.

The control unit 402 also is connected with the communication unit 410 and the memory 412 of the communication system in the powered vehicle 400. The memory 412 can represent an onboard device that electronically and/or magnetically stores data. For example, the memory 412 may represent a computer hard drive, random access memory, read-only memory, dynamic random access memory, an optical drive, or the like.

The communication unit 410 includes or represents hardware and/or software that is used to communicate with other vehicles 400 in the vehicle consist 102. For example, the communication unit 410 may include a transceiver 414 and associated circuitry for wirelessly communicating (e.g., communicating and/or receiving) command messages, reply messages, retry messages, and/or repeat messages, as described above. Additionally or alternatively, the communication unit 410 include circuitry for communicating command messages, reply messages, retry messages, and/or repeat messages over a wired connection 416, such as an electric multiple unit (eMU) line of the vehicle consist 102 or another conductive pathway between or among the powered vehicles 104, 106, 400 in the vehicle consist 102. The control unit 402 may control the communication unit 410 by activating the communication unit 410 (as described above). The communication unit 410 can examine the messages that are received by the powered unit 400 as described above. For example, the communication unit 410 of a remote vehicle 106 can examine received command messages to determine the directive sent by the lead vehicle 104. The directive can be conveyed to the control unit 402, which then implements the directive by creating control signals that are communicated to the propulsion subsystem 408 for autonomous control or by presenting the directive to the operator on the output device 406 for manual implementation of the directive.

The communication unit 410 of a remote vehicle 106 can examine received reply messages sent by other remote vehicles 106 to determine the identities and statuses of the other remote vehicles 106, as described above. The communication unit 410 can store these received identities and statuses in the memory 412. The communication unit 410 of a remote vehicle 106 can receive and examine retry messages sent by the lead vehicle 104 and determine if the memory 412 has the statuses stored of the missing remote vehicles 106 that are identified in the retry messages, as described above. The communication unit 410 can communicate the repeat messages to provide the lead vehicle 104 with the stored statuses. The communication unit 410 of the remote vehicles 104 also can re-communicate the command messages received from the lead vehicle 104, as described above.

The communication unit 410 of the lead vehicle 104 can communicate the command messages and determine which remote vehicles 106 have not responded with the statuses of the remote vehicles 106. The communication unit 410 can then communicate the retry messages that include the identities of the remote vehicles 106 having missing statues, as described above.

While one or more embodiments described herein include the remote vehicles communicating messages in time slots assigned to the remote vehicles, alternatively, the remote vehicles may communicate messages in another order. For example, the remote vehicles may determine other time slots in which the remote vehicles can communicate the messages based on the order that the messages are received from other remote vehicles. This can allow the remote vehicles to dynamically adjust the time slots in which the remote vehicles communicate messages to reduce the amount of bandwidth consumed by the remote vehicles (relative to the remote vehicles only communicating messages during the assigned time slots).

In one embodiment, a method (e.g., for communicating in a vehicle consist) includes, onboard a first remote vehicle in a vehicle consist having at least a lead vehicle, the first remote vehicle, and a second remote vehicle, receiving a second reply message from the second remote vehicle in response to communication of a command message from the lead vehicle to the first remote vehicle and the second remote vehicle. The command message includes a directive for controlling one or more operations of the first remote vehicle and the second remote vehicle. The second reply message indicates a status of the second remote vehicle. The method also can include combining the status of the second remote vehicle at the first remote vehicle with a status of one or more of the first remote vehicle or another vehicle in the vehicle consist into a concatenated relayed message, and communicating the concatenated relayed message from the first remote vehicle to the lead vehicle such that the lead vehicle receives the status of the second remote vehicle.

In one aspect, the status of the second remote vehicle differs from the status of the one or more of the first remote vehicle or another vehicle in the vehicle consist.

In one aspect, the method also can include communicating a first reply message from the first remote vehicle to the lead vehicle in response to receiving the command message at the first remote vehicle. The first reply message can indicate a status of the first remote vehicle.

In one aspect, the status of the second remote vehicle is communicated to the lead vehicle in the concatenated relayed message such that the lead vehicle indirectly receives the statuses of the second remote vehicle from the first remote vehicle.

In one aspect, the status of the second remote vehicle is combined into a single message at the first remote vehicle that is communicated to the lead vehicle as the concatenated relayed message.

In one aspect, the command message and the second reply message are each communicated once in a message cycle of the vehicle consist.

In one aspect, the first remote vehicle is located closer to the lead vehicle in the vehicle consist than the second remote vehicle.

In one aspect, the method also can include restricting the first remote vehicle to communicating a first reply message to the command message from the first remote vehicle to the lead vehicle during an originating time slot assigned to the first remote vehicle and restricting the first remote vehicle to communicating the concatenated relayed message from the first remote vehicle to the lead vehicle during a non-overlapping relaying time slot assigned to the first remote vehicle.

In one aspect, the first reply message is communicated from the first remote vehicle to the lead vehicle during the originating time slot assigned to the first remote vehicle in a message cycle of the vehicle consist and the concatenated relayed message is communicated from the first remote vehicle to the lead vehicle during the relaying time slot assigned to the first remote vehicle in the same message cycle of the vehicle consist.

In one aspect, the method also includes dynamically assigning time slots to the first remote vehicle and the second remote vehicle. The time slots indicate time periods in which the first remote vehicle and the second remote vehicle communicate one or more of the first reply message, the concatenated relayed message, or the second reply message. The remote vehicles may be prevented from communicating outside of the time slots assigned to the remote vehicles. The time slots can be dynamically assigned based on when the second reply message is received by the first remote vehicle. For example, if the first remote vehicle receives the second reply message before another remote vehicle (e.g., a third remote vehicle) receives the second reply message or another reply message, then the first remote vehicle may be assigned an earlier time slot than the third remote vehicle in which to communicate the concatenated relayed message. As another example, if the first remote vehicle receives the second reply message after another remote vehicle (e.g., a third remote vehicle) receives the second reply message or another reply message, then the first remote vehicle may be assigned a later time slot than the third remote vehicle in which to communicate the concatenated relayed message.

In another embodiment, a system (e.g., a communication system of a vehicle consist) includes a remote communication unit and a control unit. The remote communication unit is configured to be disposed onboard a first remote vehicle in a vehicle consist having at least a lead vehicle, the first remote vehicle, and a second remote vehicle. The remote communication unit also can be configured to receive a second reply message from the second remote vehicle in response to communication of a command message from the lead vehicle to the first remote vehicle and the second remote vehicle. The command message includes a directive for controlling one or more operations of the first remote vehicle and the second remote vehicle, the second reply message indicating a status of the second remote vehicle. The control unit can be configured to be disposed onboard the first remote vehicle and to combine the status of the second remote vehicle at the first remote vehicle with a status of one or more of the first remote vehicle or another vehicle in the vehicle consist into a concatenated relayed message. The control unit also can be configured to direct the remote communication unit to communicate the concatenated relayed message to the lead vehicle such that the lead vehicle receives the status of the second remote vehicle.

In one aspect, the remote communication unit also can be configured to communicate a first reply message to the lead vehicle in response to receiving the command message at the first remote vehicle. The first reply message can indicate a status of the first remote vehicle.

In one aspect, the remote communication unit is configured to communicate the status of the second remote vehicle to the lead vehicle in the concatenated relayed message such that the lead vehicle indirectly receives the status of the second remote vehicle from the first remote vehicle.

In one aspect, the control unit is configured to combine the status of the second remote vehicle into a single message that is communicated to the lead vehicle as the concatenated relayed message.

In one aspect, the first remote vehicle is located closer to the lead vehicle in the vehicle consist than the second remote vehicle.

In one aspect, the control unit is configured to prevent the remote communication unit from communicating a first reply message to the command message to the lead vehicle outside of an originating time slot assigned to the first remote vehicle and to prevent the remote communication unit from communicating the concatenated relayed message from the first remote vehicle to the lead vehicle outside of a non-overlapping relaying time slot assigned to the first remote vehicle.

In one aspect, the first reply message is communicated from the first remote vehicle to the lead vehicle during the originating time slot assigned to the first remote vehicle in a message cycle of the vehicle consist and the concatenated relayed message is communicated from the first remote vehicle to the lead vehicle during the relaying time slot assigned to the first remote vehicle in the same message cycle of the vehicle consist.

In another embodiment, a method (e.g., for communicating in a vehicle consist) includes communicating a command message from a lead vehicle in a vehicle consist having plural remote vehicles coupled with the lead vehicle. The command message includes a directive for controlling one or more operations of the remote vehicles. The method also can include separately receiving one or more reply messages from less than all of the plural remote vehicles in the vehicle consist in response to the command message. The one or more reply messages include statuses of less than all of the plural remote vehicles in the vehicle consist. The method may further include communicating a retry message from the lead vehicle that identifies a subset of the remote vehicles in the vehicle consist from which the one or more reply messages were not received in response to the command message, and receiving an individual or concatenated relayed message from a first remote vehicle in the plural remote vehicles of the vehicle consist. The individual or concatenated relayed message can include the status of one or more of the remote vehicles in the subset from which the one or more reply messages were not received.

In one aspect, the retry message also includes the directive of the command message previously communicated from the lead vehicle.

In one aspect, the method also can include repeating communication of the retry message until the reply messages are received directly from the plural remote vehicles in response to the retry message.

In another embodiment, another system (e.g., another communication system of a vehicle consist) includes a lead communication unit and a control unit. The lead communication unit is configured to be disposed onboard a lead vehicle in a vehicle consist having plural remote vehicles coupled with the lead vehicle. The lead communication unit also can be configured to communicate a command message that includes a directive for controlling one or more operations of the remote vehicles, and to separately receive one or more reply messages from less than all of the plural remote vehicles in the vehicle consist in response to the command message, the one or more reply messages including statuses of less than all of the plural remote vehicles in the vehicle consist. The control unit is configured to be disposed onboard the lead vehicle and to identify a subset of the remote vehicles in the vehicle consist from which the one or more reply messages were not received in response to the command message. The control unit can be configured to direct the lead communication unit to communicate a retry message that identifies a subset of the remote vehicles in the vehicle consist from which the one or more reply messages were not received in response to the command message. The control unit also can be configured to receive, via the lead communication unit, an individual or concatenated relayed message from a first remote vehicle in the plural remote vehicles of the vehicle consist. The individual or concatenated relayed message includes the status of one or more of the remote vehicles in the subset from which the one or more reply messages were not received.

In one aspect, the control unit also is configured to direct the lead communication unit to repeat communication of the retry message until the reply messages are received directly from the plural remote vehicles in response to the retry message.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein are intended to define the parameters of the inventive subject matter, they are by no means limiting and are exemplary embodiments. Many other embodiments will be apparent to one of ordinary skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

This written description uses examples to disclose several embodiments of the inventive subject matter and also to enable one of ordinary skill in the art to practice the embodiments of inventive subject matter, including making and using any devices or systems and performing any incorporated methods. The patentable scope of the inventive subject matter is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

The foregoing description of certain embodiments of the present inventive subject matter will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (for example, processors or memories) may be implemented in a single piece of hardware (for example, a general purpose signal processor, microcontroller, random access memory, hard disk, and the like). Similarly, the programs may be stand alone programs, may be incorporated as subroutines in an operating system, may be functions in an installed software package, and the like. The various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" of the present inventive subject matter are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

The invention claimed is:

1. A method comprising:

onboard a first remote vehicle in a vehicle consist having at least a lead vehicle and two or more remote vehicles that include, the first remote vehicle, and a second remote vehicle, receiving a reply message from the second remote vehicle using transceiver circuitry in response to communication of a command message from the lead vehicle to the first remote vehicle and the second remote vehicle, the command message including a directive for controlling one or more operations of the first remote vehicle and the second remote vehicle, the reply message including a status of the second remote vehicle; receiving a retry message from the lead vehicle that identifies a subset of the two or more remote vehicles from which a reply message was not received by the lead vehicle, the subset identifying at least the second remote vehicle;

combining the status of the second remote vehicle as received in the reply message communicated from the second remote vehicle with a status of one or more of the first remote vehicle or another remote vehicle in the vehicle consist at the first remote vehicle into a concatenated relayed message using one or more processors; and communicating the concatenated relayed message from the first remote vehicle to the lead vehicle using the transceiver circuitry such that the lead vehicle receives the status of the second remote vehicle.

2. The method of claim 1, wherein the status of the second remote vehicle differs from the status of the one or more of the first remote vehicle or another vehicle in the vehicle consist.

3. The method of claim 1, further comprising communicating a reply message from the first remote vehicle to the lead vehicle in response to receiving the command message at the first remote vehicle, the reply message communicated from the first remote vehicle indicating a status of the first remote vehicle.

4. The method of claim 1, wherein the status of the second remote vehicle is communicated to the lead vehicle in the concatenated relayed message such that the lead vehicle indirectly receives the statuses of the second remote vehicle from the first remote vehicle.

5. The method of claim 1, wherein the status of the second remote vehicle is combined into a single message at the first remote vehicle that is communicated to the lead vehicle as the concatenated relayed message.

6. The method of claim 1, wherein the command message and the reply message received from the second remote vehicle are each communicated once in a message cycle of the vehicle consist.

7. The method of claim 1, wherein the first remote vehicle is located closer to the lead vehicle in the vehicle consist than the second remote vehicle.

8. The method of claim 1, further comprising restricting the first remote vehicle to communicating a reply message to the command message from the first remote vehicle to the lead vehicle during an originating time slot assigned to the first remote vehicle and restricting the first remote vehicle to communicating the concatenated relayed message from the first remote vehicle to the lead vehicle during a non-overlapping relaying time slot assigned to the first remote vehicle.

9. The method of claim 8, wherein the reply message communicated from the first remote vehicle is communicated from the first remote vehicle to the lead vehicle during the originating time slot assigned to the first remote vehicle in a message cycle of the vehicle consist and the concatenated relayed message is communicated from the first remote vehicle to the lead vehicle during the relaying time slot assigned to the first remote vehicle in the same message cycle of the vehicle consist.

10. The method of claim 1, further comprising dynamically assigning time slots to the first remote vehicle and the second remote vehicle, the time slots indicating time periods in which the first remote vehicle and the second remote vehicle communicate one or more of a reply message communicated from the first remote vehicle to the lead vehicle in response to receiving the command message at the first remote vehicle, the concatenated relayed message, or the reply message communicated from the second remote vehicle, the time slots being dynamically assigned based on when the reply message communicated from the second remote vehicle is received by the first remote vehicle.

11. A system comprising:

a remote communication unit configured to be disposed onboard a first remote vehicle in a vehicle consist having at least a lead vehicle and two or more remote vehicles that include the first remote vehicle, and a second remote vehicle, the remote communication unit also configured to receive a reply message from the second remote vehicle in response to communication of a command message from the lead vehicle to the first remote vehicle and the second remote vehicle, the command message including a directive for controlling one or more operations of the first remote vehicle and the second remote vehicle, the reply message communicated from the second remote vehicle including a status of the second remote vehicle, the remote communication unit also configured to receive a retry message from the lead vehicle that identifies a subset of the two or more remote vehicles from which a reply message was not received by the lead vehicle, the subset identifying at least the second remote vehicle; and a control unit configured to be disposed onboard the first remote vehicle, the control unit configured to combine the status of the second remote vehicle as received in the reply message communicated from the second remote vehicle with a status of one or more of the first remote vehicle or another remote vehicle in the vehicle consist into a concatenated relayed message, wherein the control unit also is configured to direct the remote communication unit to communicate the concatenated relayed message to the lead vehicle such that the lead vehicle receives the status of the second remote vehicle.

12. The system of claim 11, wherein the remote communication unit also is configured to communicate a reply message to the lead vehicle in response to receiving the command message at the first remote vehicle, the reply message communicated from the remote communication unit indicating a status of the first remote vehicle.

13. The system of claim 11, wherein the remote communication unit is configured to communicate the status of the second remote vehicle to the lead vehicle in the concatenated relayed message such that the lead vehicle indirectly receives the status of the second remote vehicle from the first remote vehicle.

14. The system of claim 11, wherein the control unit is configured to combine the status of the second remote vehicle into a single message that is communicated to the lead vehicle as the concatenated relayed message.

15. The system of claim 11, wherein the first remote vehicle is located closer to the lead vehicle in the vehicle consist than the second remote vehicle.

16. The system of claim 11, wherein the control unit is configured to prevent the remote communication unit from communicating a reply message from the remote communication unit to the command message to the lead vehicle outside of an originating time slot assigned to the first remote vehicle and to prevent the remote communication unit from communicating the concatenated relayed message from the first remote vehicle to the lead vehicle outside of a non-overlapping relaying time slot assigned to the first remote vehicle.

17. The system of claim 16, wherein the reply message communicated from the remote communication unit is communicated from the first remote vehicle to the lead vehicle during the originating time slot assigned to the first remote vehicle in a message cycle of the vehicle consist and the concatenated relayed message is communicated from the first remote vehicle to the lead vehicle during the relaying time slot assigned to the first remote vehicle in the same message cycle of the vehicle consist.

18. A method comprising:

communicating a command message using transceiving circuitry from a lead vehicle in a vehicle consist having plural remote vehicles coupled with the lead vehicle, the command message including a directive for controlling one or more operations of the remote vehicles;

separately receiving one or more reply messages from less than all of the plural remote vehicles in the vehicle consist in response to the command message using the transceiving circuitry, the one or more reply messages including statuses of less than all of the plural remote vehicles in the vehicle consist;

communicating a retry message from the lead vehicle using the transceiving circuitry that identifies a subset of less than all of the remote vehicles in the vehicle consist from which the one or more reply messages were not received in response to the command message; and receiving an individual or concatenated relayed message from a first remote vehicle in the plural remote vehicles of the vehicle consist using the transceiving circuitry, the individual or concatenated relayed message including a combination of the status of one or more of the remote vehicles in the subset from which the one or more reply messages were not received.

19. The method of claim 18, wherein the retry message also includes the directive of the command message previously communicated from the lead vehicle.

20. The method of claim 18, further comprising repeating communication of the retry message until the reply messages are received directly from the plural remote vehicles in response to the retry message.

21. A system comprising:

a lead communication unit configured to be disposed onboard a lead vehicle in a vehicle consist having plural remote vehicles coupled with the lead vehicle, the lead communication unit also configured to communicate a command message that includes a directive for controlling one or more operations of the remote vehicles, the lead communication unit configured to separately receive one or more reply messages from less than all of the plural remote vehicles in the vehicle consist in response to the command message, the one or more reply messages including statuses of less than all of the plural remote vehicles in the vehicle consist; and a control unit configured to be disposed onboard the lead vehicle and to identify a subset of the remote vehicles in the vehicle consist from which the one or more reply messages were not received in response to the command message, the control unit configured to direct the lead communication unit to communicate a retry message that identifies a subset of less than all of the remote vehicles in the vehicle consist from which the one or more reply messages were not received in response to the command message, the control unit also configured to receive, via the lead communication unit, an individual or concatenated relayed message from a first remote vehicle in the plural remote vehicles of the vehicle consist, the individual or concatenated relayed message including a combination of the status of one or more of the remote vehicles in the subset from which the one or more reply messages were not received.

22. The system of claim 21, wherein the control unit also is configured to direct the lead communication unit to repeat communication of the retry message until the reply messages are received directly from the plural remote vehicles in response to the retry message.

* * * * *